US009126667B2

(12) United States Patent
Mizutani

(10) Patent No.: US 9,126,667 B2
(45) Date of Patent: Sep. 8, 2015

(54) MARINE VESSEL PROPULSION CONTROL DEVICE, MARINE VESSEL PROPULSION APPARATUS, AND MARINE VESSEL

(71) Applicant: YAMAHA HATSUDOKI KABUSHIKI KAISHA, Iwata-shi, Shizuoka (JP)

(72) Inventor: Makoto Mizutani, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 134 days.

(21) Appl. No.: 13/919,063

(22) Filed: Jun. 17, 2013

(65) Prior Publication Data

US 2014/0046515 A1 Feb. 13, 2014

(30) Foreign Application Priority Data

Aug. 8, 2012 (JP) ..... 2012-176029

(51) Int. Cl.

| | |
|---|---|
| ***G05D 1/00*** | (2006.01) |
| ***B63H 21/21*** | (2006.01) |
| ***B63H 25/42*** | (2006.01) |
| *B63H 20/00* | (2006.01) |
| *B63H 25/02* | (2006.01) |

(52) U.S. Cl.

CPC ..... *B63H 21/21* (2013.01); *B63H 21/213* (2013.01); *B63H 25/42* (2013.01); *B63H 2020/003* (2013.01); *B63H 2025/026* (2013.01)

(58) Field of Classification Search

None

See application file for complete search history.

(56) References Cited

U.S. PATENT DOCUMENTS

| | | | | |
|---|---|---|---|---|
| 4,942,838 | A * | 7/1990 | Boyer et al. | 114/345 |
| 6,382,122 | B1 * | 5/2002 | Gaynor et al. | 114/144 RE |
| 2007/0207683 | A1 | 9/2007 | Mizutani | |
| 2009/0076671 | A1 | 3/2009 | Mizutani | |
| 2011/0166724 | A1 | 7/2011 | Hiramatsu | |
| 2011/0172858 | A1 * | 7/2011 | Gustin et al. | 701/21 |

FOREIGN PATENT DOCUMENTS

JP 2007-083795 A 4/2007

* cited by examiner

*Primary Examiner* — Thomas Tarcza
*Assistant Examiner* — Garrett Evans
(74) *Attorney, Agent, or Firm* — Keating & Bennett, LLP

(57) ABSTRACT

A marine vessel propulsion control device includes a marine vessel maneuvering pattern storage section that stores a plurality of marine vessel maneuvering patterns corresponding to a plurality of combinations of a propulsion device attached to a marine vessel and an operation device attached to the marine vessel, a selection information storage section that stores selection information that specifies one marine vessel maneuvering pattern selected from the plurality of marine vessel maneuvering patterns, and a control section programmed to read out from the marine vessel maneuvering pattern storage section a marine vessel maneuvering pattern corresponding to selection information stored in the selection information storage section, and to output a command signal to the propulsion device according to an operation signal of the operation device based on the read-out marine vessel maneuvering pattern.

19 Claims, 23 Drawing Sheets

FIG. 13A

70A

| 71 AUXILIARY OPERATION UNIT | | | 72 PROPULSION DEVICE | | | 74 73 MARINE VESSEL MANEUVERING PATTERN | | | | | | | |
|---|---|---|---|---|---|---|---|---|---|---|---|---|---|
| | | | | | | FRONT-REAR 75 | | | | LEFT-RIGHT | | | |
| LATERAL LEVER | JOYSTICK | DUAL LEVER | THRUSTER | TROLLING MOTOR | OUTBOARD MOTOR | A | B | C | ABORT | A | B | C | D |
| ABSENT | ABSENT | ABSENT | ABSENT | ABSENT | 1 MOTOR | — | — | — | — | — | — | — | — |
| ABSENT | ABSENT | ABSENT | | | 2 MOTORS~ | — | — | — | — | — | — | — | — |
| ABSENT | ABSENT | ABSENT | | PRESENT | 1 MOTOR | — | — | — | — | — | — | — | — |
| ABSENT | ABSENT | ABSENT | | | 2 MOTORS~ | — | — | — | — | — | — | — | — |
| ABSENT | ABSENT | ABSENT | PRESENT | ABSENT | 1 MOTOR | — | — | — | — | — | — | — | — |
| ABSENT | ABSENT | ABSENT | | | 2 MOTORS~ | — | — | — | — | — | — | — | — |
| ABSENT | ABSENT | ABSENT | | PRESENT | 1 MOTOR | — | — | — | — | — | — | — | — |
| ABSENT | ABSENT | ABSENT | | | 2 MOTORS~ | — | — | — | — | — | — | — | — |

70B

| 71 AUXILIARY OPERATION UNIT | | | 72 PROPULSION DEVICE | | | 74 76 73 MARINE VESSEL MANEUVERING PATTERN | | | | | | | |
|---|---|---|---|---|---|---|---|---|---|---|---|---|---|
| | | | | | | 75 FRONT-REAR | | | | LEFT-RIGHT | | | |
| LATERAL LEVER | JOYSTICK | DUAL LEVER | THRUSTER | TROLLING MOTOR | OUTBOARD MOTOR | A | B | C | ABORT | A | B | C | D |
| PRESENT | ABSENT | ABSENT | ABSENT | ABSENT | 1 MOTOR | — | — | — | — | — | — | — | — |
| PRESENT | ABSENT | ABSENT | | | 2 MOTORS~ | — | — | — | — | — | — | — | — |
| PRESENT | ABSENT | ABSENT | | PRESENT | 1 MOTOR | — | — | — | — | ○ | ○ | ○ | ○ |
| PRESENT | ABSENT | ABSENT | | | 2 MOTORS~ | — | — | — | — | ○ | ○ | ○ | ○ |
| PRESENT | ABSENT | ABSENT | PRESENT | ABSENT | 1 MOTOR | — | — | — | — | ○ | ○ | ○ | ○ |
| PRESENT | ABSENT | ABSENT | | | 2 MOTORS~ | — | — | — | — | ○ | ○ | ○ | ○ |
| PRESENT | ABSENT | ABSENT | | PRESENT | 1 MOTOR | — | — | — | — | ○ | ○ | ○ | ○ |
| PRESENT | ABSENT | ABSENT | | | 2 MOTORS~ | — | — | — | — | ○ | ○ | ○ | ○ |

76

FIG. 13C

70C

| 71 AUXILIARY OPERATION UNIT | | | 72 PROPULSION DEVICE | | | 73 MARINE VESSEL MANEUVERING PATTERN | | | | | | | |
|---|---|---|---|---|---|---|---|---|---|---|---|---|---|
| | | | | | | 74 75 FRONT-REAR | | | | LEFT-RIGHT | | | |
| LATERAL LEVER | JOYSTICK | DUAL LEVER | THRUSTER | TROLLING MOTOR | OUTBOARD MOTOR | A | B | C | ABORT | A | B | C | D |
| ABSENT | PRESENT | ABSENT | ABSENT | ABSENT | 1 MOTOR | ○ | ○ | ○ | ○ | — | — | — | — |
| ABSENT | PRESENT | ABSENT | | | 2 MOTORS~ | ○ | ○ | ○ | ○ | — | — | — | — |
| ABSENT | PRESENT | ABSENT | | PRESENT | 1 MOTOR | ○ | ○ | ○ | ○ | ○ | ○ | ○ | ○ |
| ABSENT | PRESENT | ABSENT | | | 2 MOTORS~ | ○ | ○ | ○ | ○ | ○ | ○ | ○ | ○ |
| ABSENT | PRESENT | ABSENT | PRESENT | ABSENT | 1 MOTOR | ○ | ○ | ○ | ○ | ○ | ○ | ○ | ○ |
| ABSENT | PRESENT | ABSENT | | | 2 MOTORS~ | ○ | ○ | ○ | ○ | ○ | ○ | ○ | ○ |
| ABSENT | PRESENT | ABSENT | | PRESENT | 1 MOTOR | ○ | ○ | ○ | ○ | ○ | ○ | ○ | ○ |
| ABSENT | PRESENT | ABSENT | | | 2 MOTORS~ | ○ | ○ | ○ | ○ | ○ | ○ | ○ | ○ |

76

70D

| 71 AUXILIARY OPERATION UNIT | | | 72 PROPULSION DEVICE | | | 73 MARINE VESSEL MANEUVERING PATTERN | | | | | | | |
|---|---|---|---|---|---|---|---|---|---|---|---|---|---|
| | | | | | | 74 75 OPERATE ONLY UPPER LEVER | | | | | | | |
| LATERAL LEVER | JOYSTICK | DUAL LEVER | THRUSTER | TROLLING MOTOR | OUTBOARD MOTOR | ABORT | A | B | C | D | E | F | G |
| ABSENT | ABSENT | PRESENT | ABSENT | ABSENT | 1 MOTOR | ○ | — | — | — | — | — | — | — |
| ABSENT | ABSENT | PRESENT | | | 2 MOTORS~ | ○ | — | — | — | — | — | — | ○ |
| ABSENT | ABSENT | PRESENT | | PRESENT | 1 MOTOR | ○ | — | ○ | ○ | — | ○ | ○ | ○ |
| ABSENT | ABSENT | PRESENT | | | 2 MOTORS~ | ○ | — | ○ | ○ | — | ○ | ○ | ○ |
| ABSENT | ABSENT | PRESENT | PRESENT | ABSENT | 1 MOTOR | ○ | — | ○ | ○ | — | ○ | ○ | ○ |
| ABSENT | ABSENT | PRESENT | | | 2 MOTORS~ | ○ | — | ○ | ○ | — | ○ | ○ | ○ |
| ABSENT | ABSENT | PRESENT | | PRESENT | 1 MOTOR | ○ | — | ○ | ○ | — | ○ | ○ | ○ |
| ABSENT | ABSENT | PRESENT | | | 2 MOTORS~ | ○ | — | ○ | ○ | — | ○ | ○ | ○ |

76

FIG. 13D

| | | | TURN | | | | | |
|---|---|---|---|---|---|---|---|---|
| E | F | G | A | B | C | D | E | F |
| — | — | — | — | — | — | — | — | — |
| — | — | ○ | — | — | — | ○ | ○ | — |
| ○ | ○ | ○ | ○ | ○ | ○ | ○ | ○ | ○ |
| ○ | ○ | ○ | ○ | ○ | ○ | ○ | ○ | ○ |
| ○ | ○ | ○ | ○ | ○ | ○ | ○ | ○ | ○ |
| ○ | ○ | ○ | ○ | ○ | ○ | ○ | ○ | ○ |
| ○ | ○ | ○ | ○ | ○ | ○ | ○ | ○ | ○ |
| ○ | ○ | ○ | ○ | ○ | ○ | ○ | ○ | ○ |

| OPERATE ONLY LOWER LEVER | | | | | | | OPERATE BOTH LEVERS IN THE SAME DIRECTION | | | | | | | OPERATE BOTH LEVERS IN DIFFERENT DIRECTIONS | | | | | |
|---|---|---|---|---|---|---|---|---|---|---|---|---|---|---|---|---|---|---|---|
| ABORT | A | B | C | D | E | F | ABORT | A | B | C | D | E | F | ABORT | A | B | C | D | E |
| ○ | — | — | — | — | — | — | — | — | — | — | — | — | — | — | — | — | — | — | — |
| ○ | — | — | — | ○ | ○ | ○ | — | — | — | — | — | — | ○ | — | — | — | ○ | ○ | — |
| ○ | ○ | — | ○ | ○ | ○ | ○ | ○ | ○ | ○ | ○ | ○ | ○ | ○ | ○ | ○ | ○ | ○ | ○ | ○ |
| ○ | ○ | — | ○ | ○ | ○ | ○ | ○ | ○ | ○ | ○ | ○ | ○ | ○ | ○ | ○ | ○ | ○ | ○ | ○ |
| ○ | ○ | — | ○ | ○ | ○ | ○ | ○ | ○ | ○ | ○ | ○ | ○ | ○ | ○ | ○ | ○ | ○ | ○ | ○ |
| ○ | ○ | — | ○ | ○ | ○ | ○ | ○ | ○ | ○ | ○ | ○ | ○ | ○ | ○ | ○ | ○ | ○ | ○ | ○ |
| ○ | ○ | — | ○ | ○ | ○ | ○ | ○ | ○ | ○ | ○ | ○ | ○ | ○ | ○ | ○ | ○ | ○ | ○ | ○ |
| ○ | ○ | — | ○ | ○ | ○ | ○ | ○ | ○ | ○ | ○ | ○ | ○ | ○ | ○ | ○ | ○ | ○ | ○ | ○ |

70

FIG. 14A

| 71 | | | 72 | | |
|---|---|---|---|---|---|
| AUXILIARY OPERATION UNIT | | | PROPULSION DEVICE | | |
| LATERAL LEVER | JOYSTICK | DUAL LEVER | THRUSTER | TROLLING MOTOR | OUTBOARD MOTOR |
| ABSENT | ABSENT | ABSENT | ABSENT | ABSENT | 1 MOTOR |
| ABSENT | ABSENT | ABSENT | | | 2 MOTORS~ |
| ABSENT | ABSENT | ABSENT | | PRESENT | 1 MOTOR |
| ABSENT | ABSENT | ABSENT | | | 2 MOTORS~ |
| ABSENT | ABSENT | ABSENT | PRESENT | ABSENT | 1 MOTOR |
| ABSENT | ABSENT | ABSENT | | | 2 MOTORS~ |
| ABSENT | ABSENT | ABSENT | | PRESENT | 1 MOTOR |
| ABSENT | ABSENT | ABSENT | | | 2 MOTORS~ |
| PRESENT | ABSENT | ABSENT | ABSENT | ABSENT | 1 MOTOR |
| PRESENT | ABSENT | ABSENT | | | 2 MOTORS~ |
| PRESENT | ABSENT | ABSENT | | PRESENT | 1 MOTOR |
| PRESENT | ABSENT | ABSENT | | | 2 MOTORS~ |
| PRESENT | ABSENT | ABSENT | PRESENT | ABSENT | 1 MOTOR |
| PRESENT | ABSENT | ABSENT | | | 2 MOTORS~ |
| PRESENT | ABSENT | ABSENT | | PRESENT | 1 MOTOR |
| PRESENT | ABSENT | ABSENT | | | 2 MOTORS~ |
| ABSENT | PRESENT | ABSENT | ABSENT | ABSENT | 1 MOTOR |
| ABSENT | PRESENT | ABSENT | | | 2 MOTORS~ |
| ABSENT | PRESENT | ABSENT | | PRESENT | 1 MOTOR |
| ABSENT | PRESENT | ABSENT | | | 2 MOTORS~ |
| ABSENT | PRESENT | ABSENT | PRESENT | ABSENT | 1 MOTOR |
| ABSENT | PRESENT | ABSENT | | | 2 MOTORS~ |
| ABSENT | PRESENT | ABSENT | | PRESENT | 1 MOTOR |
| ABSENT | PRESENT | ABSENT | | | 2 MOTORS~ |
| ABSENT | ABSENT | PRESENT | ABSENT | ABSENT | 1 MOTOR |
| ABSENT | ABSENT | PRESENT | | | 2 MOTORS~ |
| ABSENT | ABSENT | PRESENT | | PRESENT | 1 MOTOR |
| ABSENT | ABSENT | PRESENT | | | 2 MOTORS~ |
| ABSENT | ABSENT | PRESENT | PRESENT | ABSENT | 1 MOTOR |
| ABSENT | ABSENT | PRESENT | | | 2 MOTORS~ |
| ABSENT | ABSENT | PRESENT | | PRESENT | 1 MOTOR |
| ABSENT | ABSENT | PRESENT | | | 2 MOTORS~ |

FIG. 14B

70

76 75 74 73

MARINE VESSEL MANEUVERING PATTERN

| FRONT-REAR | | | | LEFT-RIGHT | | | | | | | TURN | | | | | |
|---|---|---|---|---|---|---|---|---|---|---|---|---|---|---|---|---|
| A | B | C | ABORT | A | B | C | D | E | F | G | A | B | C | D | E | F |
| — | — | — | — | — | — | — | — | — | — | — | — | — | — | — | — | — |
| — | — | — | — | — | — | — | — | — | — | — | — | — | — | — | — | — |
| — | — | — | — | — | — | — | — | — | — | — | — | — | — | — | — | — |
| — | — | — | — | — | — | — | — | — | — | — | — | — | — | — | — | — |
| — | — | — | — | — | — | — | — | — | — | — | — | — | — | — | — | — |
| — | — | — | — | — | — | — | — | — | — | — | — | — | — | — | — | — |
| — | — | — | — | — | — | — | — | — | — | — | — | — | — | — | — | — |
| — | — | — | — | — | — | — | — | — | — | — | — | — | — | — | — | — |
| — | — | — | — | — | — | — | — | — | — | — | — | — | — | — | — | — |
| — | — | — | — | — | — | — | — | — | — | — | — | — | — | — | — | — |
| — | — | — | — | — | — | — | — | — | — | ○ | — | — | — | — | — | — |
| — | — | — | — | ○ | ○ | ○ | ○ | ○ | ○ | ○ | — | — | — | — | — | — |
| — | — | — | — | ○ | ○ | ○ | ○ | ○ | ○ | ○ | — | — | — | — | — | — |
| — | — | — | — | ○ | ○ | ○ | ○ | ○ | ○ | ○ | — | — | — | — | — | — |
| — | — | — | — | ○ | ○ | ○ | ○ | ○ | ○ | ○ | — | — | — | — | — | — |
| — | — | — | — | ○ | ○ | ○ | ○ | ○ | ○ | ○ | — | — | — | — | — | — |
| — | — | — | — | ○ | ○ | ○ | ○ | ○ | ○ | ○ | — | — | — | — | — | — |
| ○ | ○ | ○ | ○ | — | — | — | — | — | — | — | — | — | — | — | — | — |
| ○ | ○ | ○ | ○ | — | — | — | — | — | ○ | ○ | — | — | — | ○ | ○ | — |
| ○ | ○ | ○ | ○ | ○ | ○ | ○ | ○ | ○ | ○ | ○ | ○ | ○ | ○ | ○ | ○ | ○ |
| ○ | ○ | ○ | ○ | ○ | ○ | ○ | ○ | ○ | ○ | ○ | ○ | ○ | ○ | ○ | ○ | ○ |
| ○ | ○ | ○ | ○ | ○ | ○ | ○ | ○ | ○ | ○ | ○ | ○ | ○ | ○ | ○ | ○ | ○ |
| ○ | ○ | ○ | ○ | ○ | ○ | ○ | ○ | ○ | ○ | ○ | ○ | ○ | ○ | ○ | ○ | ○ |
| ○ | ○ | ○ | ○ | ○ | ○ | ○ | ○ | ○ | ○ | ○ | ○ | ○ | ○ | ○ | ○ | ○ |
| ○ | ○ | ○ | ○ | ○ | ○ | ○ | ○ | ○ | ○ | ○ | ○ | ○ | ○ | ○ | ○ | ○ |

FIG. 14C

| OPERATE ONLY UPPER LEVER | | | | | | | | OPERATE ONLY LOWER LEVER | | | | | | |
|---|---|---|---|---|---|---|---|---|---|---|---|---|---|---|
| ABORT | A | B | C | D | E | F | G | ABORT | A | B | C | D | E | F |
| | | | | | | | | | | | | | | |
| | | | | | | | | | | | | | | |
| | | | | | | | | | | | | | |

FIG. 14D

| OPERATE BOTH LEVERS IN THE SAME DIRECTION | | | | | | | OPERATE BOTH LEVERS IN DIFFERENT DIRECTIONS | | | | | |
|---|---|---|---|---|---|---|---|---|---|---|---|---|
| ABORT | A | B | C | D | E | F | ABORT | A | B | C | D | E |
| | | | | | | | | | | | | |
| | | | | | | | | | | | | |
| | | | | | | | | | | | | |
| | | | | | | | | | | | | |
| | | | | | | | | | | | | |
| | | | | | | | | | | | | |
| | | | | | | | | | | | | |
| | | | | | | | | | | | | |
| | | | | | | | | | | | | |
| | | | | | | | | | | | | |
| | | | | | | | | | | | | |
| | | | | | | | | | | | | |
| | | | | | | | | | | | | |
| | | | | | | | | | | | | |
| | | | | | | | | | | | | |
| | | | | | | | | | | | | |
| | | | | | | | | | | | | |
| | | | | | | | | | | | | |
| | | | | | | | | | | | | |
| | | | | | | | | | | | | |
| | | | | | | | | | | | | |
| | | | | | | | | | | | | |
| | | | | | | | | | | | | |
| | | | | | | | | | | | | |
| — | — | — | — | — | — | — | — | — | — | — | — | — |
| — | — | — | — | — | — | ○ | — | — | — | ○ | ○ | — |
| ○ | ○ | ○ | ○ | ○ | ○ | ○ | ○ | ○ | ○ | ○ | ○ | ○ |
| ○ | ○ | ○ | ○ | ○ | ○ | ○ | ○ | ○ | ○ | ○ | ○ | ○ |
| ○ | ○ | ○ | ○ | ○ | ○ | ○ | ○ | ○ | ○ | ○ | ○ | ○ |
| ○ | ○ | ○ | ○ | ○ | ○ | ○ | ○ | ○ | ○ | ○ | ○ | ○ |
| ○ | ○ | ○ | ○ | ○ | ○ | ○ | ○ | ○ | ○ | ○ | ○ | ○ |
| ○ | ○ | ○ | ○ | ○ | ○ | ○ | ○ | ○ | ○ | ○ | ○ | ○ |

MARINE VESSEL PROPULSION CONTROL DEVICE, MARINE VESSEL PROPULSION APPARATUS, AND MARINE VESSEL

BACKGROUND OF THE INVENTION

1. Field of the Invention

The present invention relates to a marine vessel propulsion control device that controls a propulsion device attached to a marine vessel, and a marine vessel propulsion apparatus including a propulsion device and an operation device attached to a marine vessel. The present invention further relates to a marine vessel including a hull and a propulsion device and an operation device attached to the hull.

2. Description of the Related Art

Propulsion devices for marine vessels are attached to hulls to provide thrust forces to the hulls. Examples of the propulsion devices include outboard motors and bow thrusters. A plurality of propulsion devices are sometimes mounted on a hull. For example, in some cases, a plurality of outboard motors are mounted on a hull. Moreover, in some other cases, a bow thruster is mounted in addition to a single or a plurality of outboard motors. Depending on the number and type of propulsion devices mounted on a hull, the type of available hull behavior varies. The hull behavior means the hull's behavior related to a movement and rotation of the hull.

A marine vessel operator achieves a desired hull behavior by causing the propulsion device to operate appropriately. More specifically, operation devices for marine vessel maneuvering are provided on a marine vessel. Examples of the operation devices include steering wheels, levers, joysticks, and switches. As a result of the propulsion device operating according to operations of these operation devices, the moving direction, moving speed, rotating direction, and rotating speed of the hull can be controlled.

For example, when a plurality of propulsion devices are provided, the hull can be caused to move in the lateral direction by appropriately adjusting their operation. There is not always one combination of operations of the plurality of propulsion devices in this case, but generally, a plurality of combinations are available. With a larger number of propulsion devices attached to the hull, the number of combinations of operations of the propulsion devices for achieving one hull behavior increases accordingly.

US 2009/0076671 A1 discloses an arrangement of estimating a traveling plan based on a combination of the operational states of operation devices and the traveling state, and automatically selecting a marine vessel maneuvering device to obtain a target controlling force corresponding to the traveling plan. Accordingly, the selection of a marine vessel maneuvering device and the driving state can be optimized, and a desired traveling state can be achieved irrespective of the marine vessel operator's knowledge and experience.

US 2011/0166724 A1 discloses an arrangement in which the output and steering angle of an outboard motor are automatically controlled according to an operation of a joystick unit. More specifically, an operation pattern of the outboard motor is automatically selected according to an operation of the joystick unit and a current steering angle of the outboard motor. Accordingly, the steering operation of the outboard motor is minimized, while a hull behavior according to an operation of the joystick unit is achieved.

SUMMARY OF THE INVENTION

The inventor of preferred embodiments of the present invention described and claimed in the present application conducted an extensive study and research regarding a marine vessel propulsion control device, such as the ones described above, and in doing so, discovered and first recognized new unique challenges and previously unrecognized possibilities for improvements as described in greater detail below.

The arrangements of US 2009/0076671 A1 and US 2011/0166724 A1 both provide a function that is convenient for an unskilled marine vessel operator, but control desired by a skilled marine vessel operator is not always carried out. That is, a skilled marine vessel operator sometimes desires a marine vessel maneuvering pattern different from a marine vessel maneuvering pattern based on the control automatically selected by the system. Moreover, depending on the use of the marine vessel or a hull shape, marine vessel maneuvering characteristics different from the marine vessel maneuvering characteristics based on the automatically selected control may be desired. Further, if one or more propulsion devices are added, a marine vessel maneuvering pattern that had been optimal in the existing system may no longer be optimal.

Although these challenges might be solved by rewriting the control program of the control unit, it will require a great deal of time and labor to rewrite the control program. In particular, it is not practically feasible to rewrite the control program corresponding to each users' individual demands.

In order to overcome the previously unrecognized and unsolved challenges described above, a preferred embodiment of the present invention provides a marine vessel propulsion control device including a marine vessel maneuvering pattern storage section that stores a plurality of marine vessel maneuvering patterns corresponding to a plurality of combinations of propulsion devices attached to a marine vessel and an operation device attached to the marine vessel (for example, including a plurality of propulsion device drive patterns corresponding to a specific operation of the operation device), a selection information storage section that stores selection information that specifies one marine vessel maneuvering pattern selected from the plurality of marine vessel maneuvering patterns, and a control section programmed to read out from the marine vessel maneuvering pattern storage section a marine vessel maneuvering pattern corresponding to selection information stored in the selection information storage section, and outputs a command signal to the propulsion device according to an operation signal of the operation device, based on the read-out marine vessel maneuvering pattern.

According to this arrangement, the marine vessel maneuvering pattern storage section has stored a plurality of marine vessel maneuvering patterns, and based on a marine vessel maneuvering pattern selected therefrom, a command signal according to an operation signal of the operation device is provided to the propulsion device. Accordingly, a hull behavior corresponding to a previously selected marine vessel maneuvering pattern is obtained according to an operation of the operation device, and therefore, operations for marine vessel maneuvering are easy. Moreover, because the marine vessel maneuvering pattern storage section has stored a plurality of marine vessel maneuvering patterns, if another marine vessel maneuvering pattern is selected, the marine vessel maneuvering pattern can be changed. Consequently, a marine vessel maneuvering pattern can be selected according to necessity without rewriting the control program. Accordingly, marine vessel maneuvering characteristics due to a marine vessel maneuvering pattern according to each users' individual wishes and the use or shape of the marine vessel, etc., can be achieved.

The marine vessel maneuvering pattern may include corresponding information between an operation of the operation device and a drive pattern of the propulsion device. For example, a plurality of marine vessel maneuvering patterns may be prepared for a specific operation of the operation device. The plurality of marine vessel maneuvering patterns may include corresponding information of different pulsation device drive patterns to a specific operation of the operation device.

The marine vessel propulsion control device according to a preferred embodiment of the present invention further includes a selection device to be operated by an operator to select one of the plurality of marine vessel maneuvering patterns stored in the marine vessel maneuvering pattern storage section, and a selection information writing section that writes in the selection information storage section selection information to identify a marine vessel maneuvering pattern selected by the selection device.

According to this arrangement, when the operator selects one marine vessel maneuvering pattern by operating the selection device, selection information to specify the selected marine vessel maneuvering pattern is written in the selection information storage section. Thus, by the operator's operation, the selection information in the selection information storage section can be updated. The marine vessel maneuvering pattern can thus be changed. The operator in this case may be either a user of the marine vessel or a boat builder who builds the marine vessel by attaching the operation device and the propulsion device to a hull.

The selection device is preferably arranged to allow selection of one of the plurality of marine vessel maneuvering patterns that are selectable for a specific operation of the operation device. Moreover, the selection device is preferably arranged to allow further selection of one of another plurality of marine vessel maneuvering patterns that are selectable for another specific operation of the operation device. In accordance with such a selection device, the selection information writing section is preferably arranged to write in the selection information storage section selection information indicating one marine vessel maneuvering pattern corresponding to each specific operation.

The marine vessel propulsion control device according to a preferred embodiment of the present invention further includes an equipment recognition section that recognizes a propulsion device and an operation device that are actually equipped on a marine vessel, and a marine vessel maneuvering pattern extraction section that extracts a selectable marine vessel maneuvering pattern from a plurality of marine vessel maneuvering patterns stored in the marine vessel maneuvering pattern storage section, based on a propulsion device and an operation device recognized by the equipment recognition section. In this case, the selection device is preferably arranged such that selection of a marine vessel maneuvering pattern by an operator is possible from a plurality of marine vessel maneuvering patterns extracted by the marine vessel maneuvering pattern extraction section.

According to this arrangement, the actual equipment of the marine vessel, that is, the propulsion device and the operation device actually equipped on the marine vessel are recognized by the equipment recognition section. Further, a selectable marine vessel maneuvering pattern is extracted according to the equipment recognized by the equipment recognition section. A marine vessel maneuvering pattern that is selectable by the selection device operated by an operator is limited to the extracted marine vessel maneuvering pattern. Thus, the operator can select one marine vessel maneuvering pattern from actually selectable marine vessel maneuvering patterns, so that a selecting operation of a marine vessel maneuvering pattern becomes easy.

The selection device preferably includes an option display unit that displays as an option a marine vessel maneuvering pattern that is selectable by an operator. Due to this arrangement, a marine vessel maneuvering pattern that is selectable by an operator is displayed as an option, so that selection of a marine vessel maneuvering pattern becomes even easier.

Selection information stored in the selection information storage section is preferably maintained as former information until a selecting operation of a new marine vessel maneuvering pattern is performed by the selection device. According to this arrangement, the selection information which is a memory content of the selection information storage section is maintained at a former value until an operator operates the selection device for rewriting. Accordingly, it is not necessary to perform a selecting operation of a marine vessel maneuvering pattern every time marine vessel maneuvering is performed, so that marine vessel maneuvering intended by the user becomes even easier.

The marine vessel propulsion control device according to a preferred embodiment of the present invention preferably further includes a marine vessel maneuvering pattern rewriting section that rewrites a marine vessel maneuvering pattern stored in the marine vessel maneuvering pattern storage section. According to this arrangement, a new marine vessel maneuvering pattern can be written in the marine vessel maneuvering pattern storage section. That is, the memory content of the marine vessel maneuvering pattern storage section can be updated according to necessity.

The marine vessel propulsion control device according to a preferred embodiment of the present invention further includes an operation device recognition section that recognizes the type of an operation device that is actually equipped on a marine vessel. According to this arrangement, the type of an operation device that is equipped on a marine vessel is recognized, so that when options for marine vessel manipulating patterns are limited, an appropriate marine vessel maneuvering pattern can be extracted.

The operation device recognition section may be programmed to recognize the type of an operation device based on type identification information generated by the operation device. According to this arrangement, the type of an operation device is recognized based on type identification information generated by the operation device. Therefore, the type of an operation device can be reliably recognized, so that a selectable marine vessel maneuvering pattern can be appropriately extracted.

The operation device recognition section may be programmed to obtain information to identify the type of an operation device that is actually equipped on a marine vessel from an external input device. This arrangement allows recognizing the type of an operation device by an external input, and thus simplifies the configuration of the operation device recognition section, and allows coping with an operation device that generates no type identification information.

The operation device recognition section may be programmed to recognize the type of the operation device based on the type of an interface to which the operation device is connected. In this arrangement, the type of the operation device is recognized based on the type of an interface, so that the type of even an operation device that generates no type identification information can be automatically recognized based on the type of the interface.

In a preferred embodiment of the present invention, the marine vessel maneuvering pattern storage section has stored a marine vessel maneuvering pattern including operation instruction information corresponding to the type of an operation device. According to this arrangement, the marine vessel maneuvering pattern storage section has stored a marine vessel maneuvering pattern including operation instruction information corresponding to the type of an operation device. The operation instruction information may be, for example, information concerning the operation type or operating direction such as, for example, a front-rear direction, a left-right direction, or a clockwise/counterclockwise turn. Moreover, the operation instruction information may be information concerning ON/OFF of an operation switch included in the operation device.

The marine vessel propulsion control device according to a preferred embodiment of the present invention further includes a propulsion device recognition section that recognizes the type of a propulsion device that is actually equipped on a marine vessel. According to this arrangement, the type of a propulsion device that is actually equipped on a marine vessel is recognized, so that a marine vessel maneuvering pattern corresponding to the recognized propulsion device can be extracted, and a marine vessel maneuvering pattern can be easily selected from a plurality of the extracted marine vessel maneuvering patterns.

The propulsion device recognition section may be programmed to recognize the type of a propulsion device based on type identification information generated by the propulsion device. According to this arrangement, the type of a propulsion device can be automatically and accurately recognized based on type identification information generated by the propulsion device.

The propulsion device recognition section may be programmed to obtain information to identify the type of a propulsion device that is actually equipped on a marine vessel from an external input device. According to this arrangement, the type of a propulsion device can be recognized by an external input even when the propulsion device generates no type identification information.

The marine vessel maneuvering pattern storage section has preferably stored a marine vessel maneuvering pattern corresponding to propulsion device number information indicating the number of the same type of propulsion devices. According to this arrangement, a marine vessel maneuvering pattern corresponding to the number of propulsion devices is included. Therefore, an appropriate marine vessel maneuvering pattern can be selected according to the number of propulsion devices, so that a more appropriate marine vessel maneuvering pattern can be used.

In the marine vessel propulsion control device according to a preferred embodiment of the present invention, the operation device includes an output adjustment unit to be operated by a user in order to adjust an output of a propulsion device. In this case, the control section may be provided on the output adjustment unit. According to this arrangement, the control section is provided on the output adjustment unit, so that the control of marine vessel maneuvering patterns and the output adjustment of a propulsion device can be integrated into the output adjustment unit. Moreover, a control unit included in the output adjustment unit may be used also as a control section that selects a marine vessel maneuvering pattern.

In a preferred embodiment of the present invention, the operation device further includes an auxiliary operation unit, and the output adjustment unit includes an auxiliary unit attaching portion arranged to allow attaching and removing of the auxiliary operation unit. According to this arrangement, the auxiliary operation unit can be attached and removed to and from the output adjustment unit, so that it becomes no longer necessary to provide a special space to dispose the auxiliary operation unit on an operator seat. The layout of a marine vessel maneuvering space can thus be simplified, and further, an operation system that is easy to operate can be provided. Moreover, because the auxiliary operation unit can be attached and removed, a necessary auxiliary operation unit can be selected and provided integrally with the output adjustment unit.

The marine vessel maneuvering pattern preferably includes a marine vessel maneuvering pattern correspondence between the type of an auxiliary operation unit and a propulsion device drive pattern that corresponds to the type of the auxiliary operation unit. More specifically, the marine vessel maneuvering pattern preferably includes a marine vessel maneuvering pattern correspondence between an auxiliary operation unit operation and a propulsion device drive pattern that corresponds to the operation.

The output adjustment unit may include a lever to be operated by a user. In this case, the control section is preferably arranged and programmed to control an output of the propulsion device in response to an operation of the lever. According to this arrangement, when a user operates the lever, an output according to that operation is generated from the propulsion device. If an auxiliary adjustment unit has been integrated in such an output adjustment unit, switching of the operation system can be smoothly performed, so that a marine vessel having excellent marine vessel maneuverability can be provided.

Examples of the auxiliary operation unit include a lateral lever unit including a lateral lever that is tiltable in the left-right direction, a lateral dual lever unit including a pair of lateral levers, a joystick unit including a lever that is tiltable to the front, rear, left, and right and turnable about an axis, a cross key unit including directional keys to the front, rear, left, and right, and a switch unit including a pair of front and rear or left and right switches.

A preferred embodiment of the present invention includes a marine vessel propulsion apparatus including a propulsion device attached to a marine vessel, an operation device attached to a marine vessel, and a marine vessel propulsion control device having the characteristics described above. According to this arrangement, a marine vessel propulsion apparatus capable of easily changing the marine vessel maneuvering pattern can be provided.

A preferred embodiment of the present invention includes a marine vessel including a hull, a propulsion device attached to the hull, an operation device attached to the hull, and a marine vessel propulsion control device having the characteristics described above. According to this arrangement, a marine vessel in which a change in marine vessel maneuvering pattern is easy, and which easily obtains a hull behavior desired by a user can be provided.

The above and other elements, features, steps, characteristics and advantages of the present invention will become more apparent from the following detailed description of the preferred embodiments with reference to the attached drawings.

BRIEF DESCRIPTION OF THE DRAWINGS

FIGS. 13A to 13D show a non-limiting example of a marine vessel maneuvering pattern extraction map.

FIGS. 14A to 14D show another non-limiting example of the marine vessel maneuvering pattern extraction map.

DETAILED DESCRIPTION OF THE PREFERRED EMBODIMENTS

Figure 1:
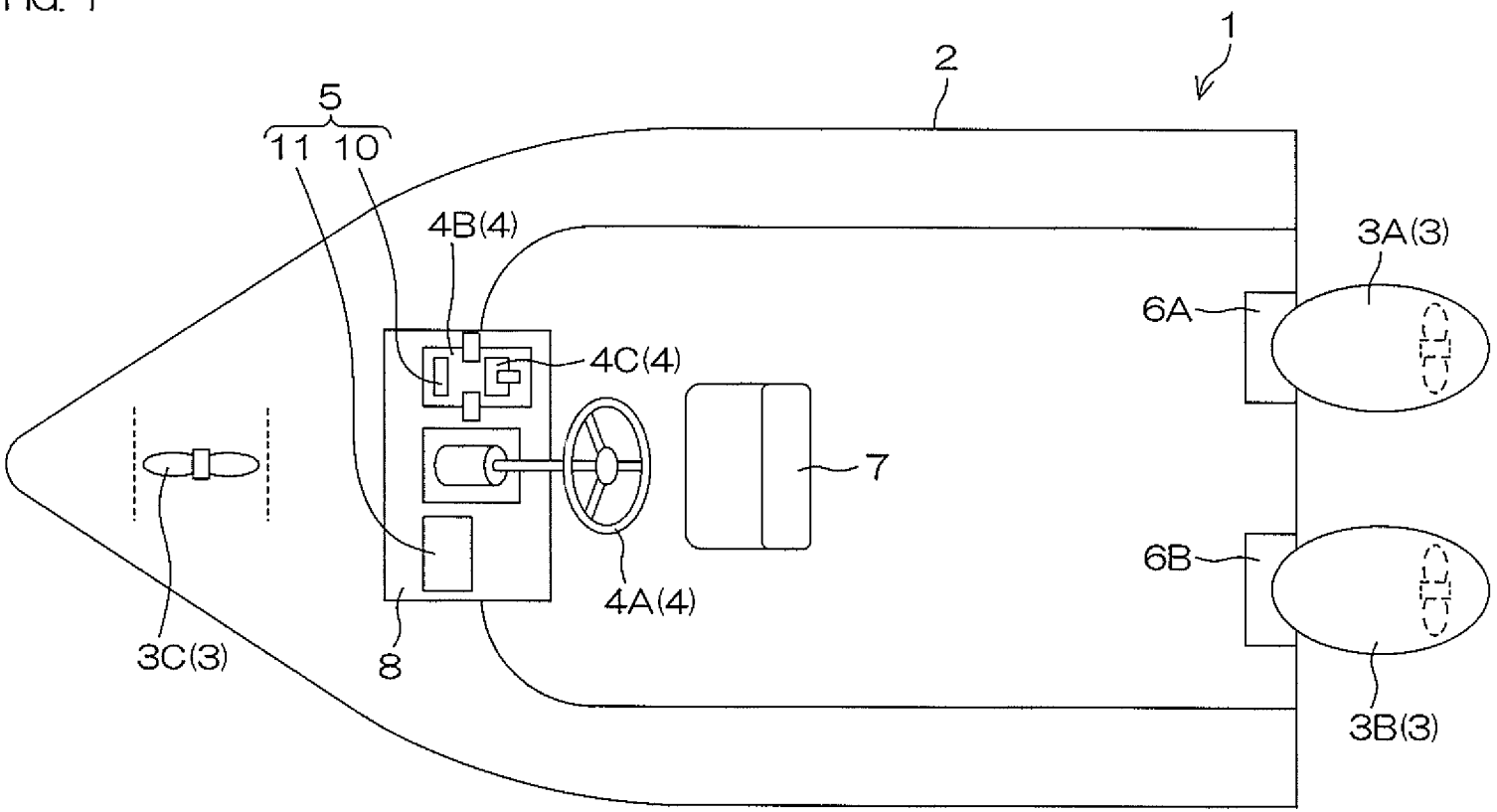
FIG. 1 is a schematic plan view for explaining a non-limiting example of a marine vessel according to a preferred embodiment of the present invention.
Figure 2:
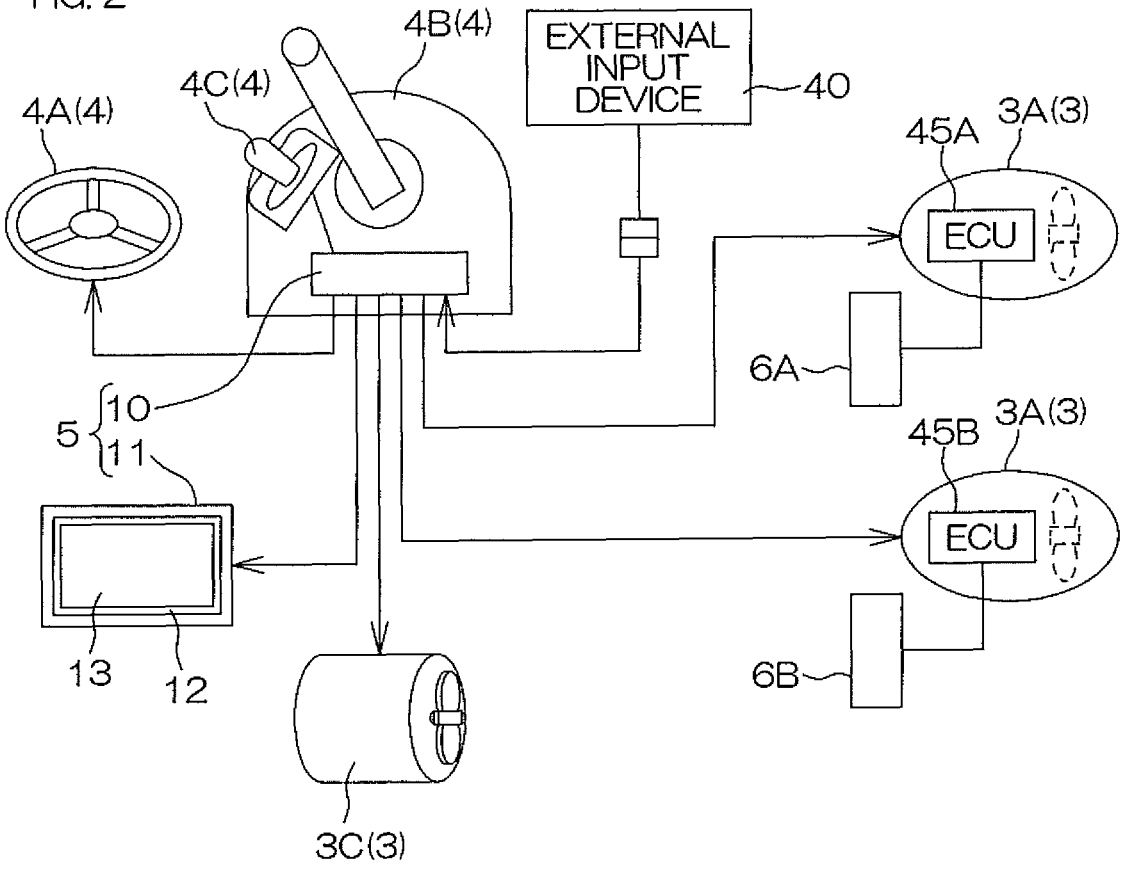
FIG. 2 is a system configuration diagram of a marine vessel propulsion system provided on the marine vessel.

FIG. 1 is a schematic plan view for explaining a non-limiting example of a marine vessel according to a preferred embodiment of the present invention. FIG. 2 is a system configuration diagram of a marine vessel propulsion system provided on the marine vessel 1.

The marine vessel 1 includes a hull 2, propulsion devices 3 attached to the hull 2, operation devices 4 attached to the hull 2, and a marine vessel propulsion control device 5 attached to the hull 2. The propulsion devices 3, in the non-limiting example of FIG. 1, preferably include two outboard motors 3A and 3B attached to the stem and a bow thruster 3C attached near the bow. The operation devices 4, in the non-limiting example of FIG. 1, include a steering wheel 4A, an output adjustment unit 4B, and an auxiliary operation unit 4C.

Each of the outboard motors 3A and 3B includes a motor serving as a drive source, a propeller that rotates due to a driving force generated by the motor, and a shift mechanism interposed in a driving force transmission path extending from the motor to the propeller. The motor may be either an internal combustion engine or an electric motor. The shift mechanism may include a clutch mechanism that switches between a state of transmitting a motor rotation to the propeller and a state of not transmitting a motor rotation to the propeller. More specifically, the shift mechanism may be switchable among a plurality of shift positions including a forward drive position where a motor rotation is transmitted to make the propeller undergo forward drive rotation, a rearward drive position where a motor rotation is transmitted to make the propeller undergo rearward drive rotation, and a neutral position where a motor rotation is not transmitted to the propeller. The forward drive rotation is a rotation in a direction to generate a thrust force to drive the hull 2 forward, and the rearward drive rotation is a rotation in a direction to generate a thrust force to drive the hull 2 rearward.

The outboard motors 3A and 3B are respectively attached to the hull 2 so as to be turnable to the left and right. The turning angles to the left and right are called steering angles. For changing the steering angles of the outboard motors 3A and 3B, steering units 6A and 6B corresponding to the outboard motors 3A and 3B, respectively, are provided. The steering units 6A and 6B are arranged to change the steering angles of the outboard motors 3A and 3B by respectively turning the outboard motors 3A and 3B to the left and right.

The bow thruster 3C includes, for example, an electric motor serving as a motor and a propeller that rotates about a rotation axis along the left-right direction of the hull 2 due to a driving force generated by the electric motor. By rotating the electric motor in a normal rotation direction or a reverse rotation direction opposite thereto, the bow thruster 3C provides a thrust force in the right direction or left direction to a bow portion of the hull 2.

The operation devices 4 are disposed close to a marine vessel operator seat 7 on which a marine vessel operator sits. More specifically, the steering wheel 4A is disposed on an operation panel 8 in front of the marine vessel operator seat 7. The steering units 6A and 6B are actuated according to an operation of the steering wheel 4A, and the steering angles of the outboard motors 3A and 3B are thus changed. Accordingly, the marine vessel 1 can be steered. The output adjustment unit 4B is disposed on the operation panel 8 on a side of the steering wheel 4A. The output adjustment unit 4B includes, for example, a pair of left and right levers corresponding to the outboard motors 3A and 3B, respectively. The levers can be respectively operated by being tilted in the forward and rearward directions. By operating the respective levers, the shift positions and outputs (motor outputs) of the outboard motors 3A and 3B can be adjusted.

The auxiliary operation unit 4C is, in the present preferred embodiment, incorporated into the output adjustment unit 4B. Non-limiting examples of the auxiliary operation unit 4*c* include a lateral lever unit including a lateral lever that is tiltable to the left and right, a lateral dual lever unit including a pair of lateral levers that are tiltable to the left and right, a joystick unit including a lever that is tiltable in any direction and turnable about an axis, a lateral switch unit including a pair of left and right switches, and a cross key unit including operation keys at the front, rear, left, and right. Besides these, for example, like a combination of the lateral lever unit and a front-rear-direction switch unit including a pair of front and rear switches, the auxiliary operation unit 4C may include a combination of two or more types of switch units. The joystick unit may include a turnable knob in a lever head portion in place of a lever that is turnable about an axis.

The marine vessel propulsion apparatus 5 is connected to the operation devices 4 and the propulsion devices 3, and controls the operation of the propulsion devices 3 according to command signals input from the operation devices 4. The marine vessel propulsion apparatus 5, in the present preferred embodiment, includes a control unit (ECU: Electronic Control Unit) 10 provided on the output adjustment unit 4B and an input device 11 disposed on the operation panel 8.

Figure 3:
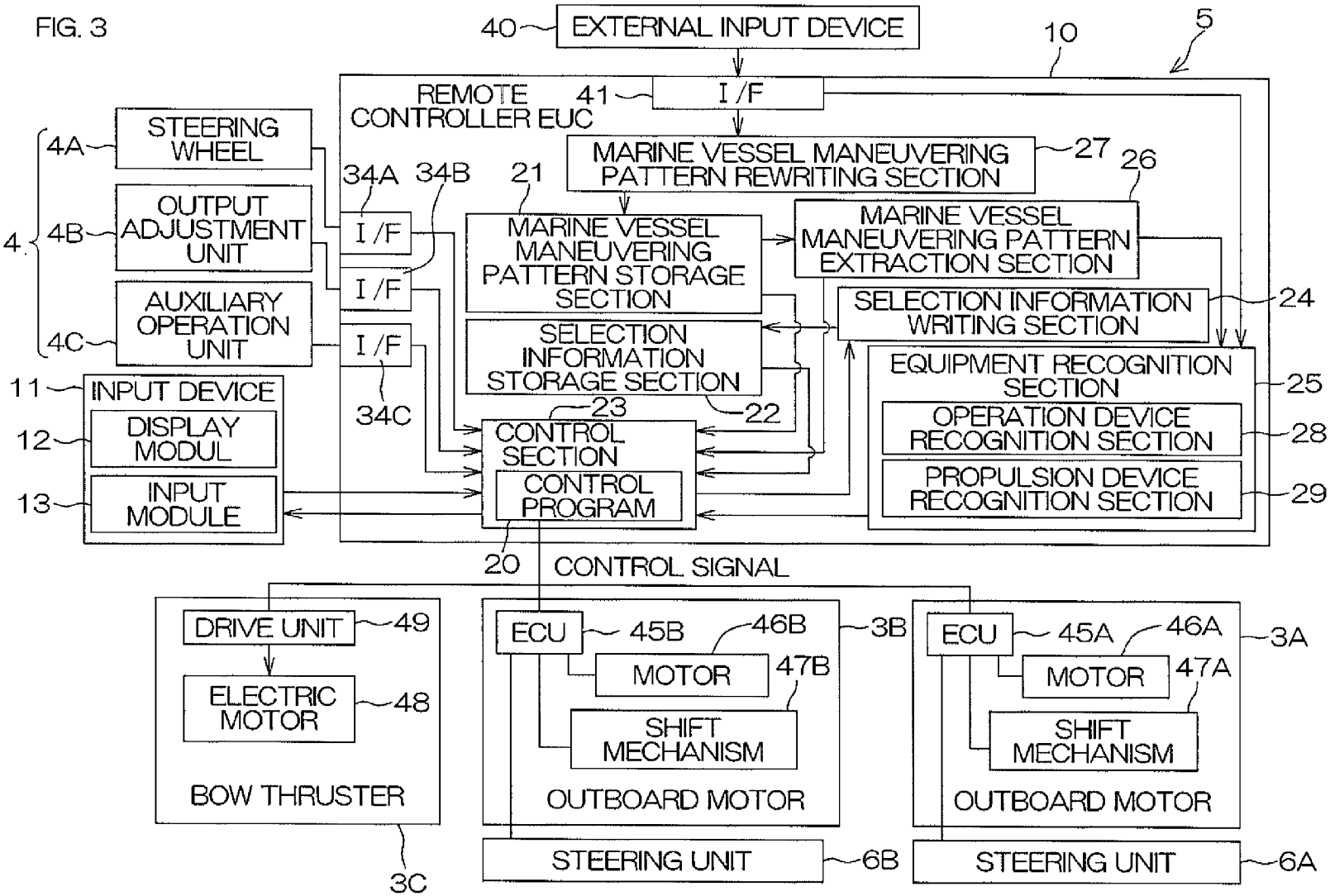
FIG. 3 is a block diagram for explaining a configuration related to a control by a marine vessel propulsion control device provided on the marine vessel.

FIG. 3 is a block diagram for explaining a configuration related to control by the marine vessel propulsion control device 5. The control unit 10 includes a basic configuration of a computer, and includes a CPU (Central Processing Unit), a ROM that stores control programs to be executed by the CPU, a RAM to be used as a working memory of the CPU, and an external storage, etc. The control unit 10 includes a plurality of functional processing sections as a result of the CPU executing the control programs. The plurality of functional processing sections include, for example, a marine vessel maneuvering pattern storage section 21, a selection information storage section 22, a control section 23, a selection information writing section 24, an equipment recognition section 25, a marine vessel maneuvering pattern extraction section 26, and a marine vessel maneuvering pattern rewriting section 27. The equipment recognition section 25 includes, for example, an operation device recognition section 28 and a propulsion device recognition section 29.

The marine vessel maneuvering pattern storage section 21 stores a plurality of marine vessel maneuvering patterns corresponding to a combination of the propulsion devices 3 and the operation devices 4 attached to the marine vessel 1. The marine vessel maneuvering pattern includes corresponding information between an operation of the operation devices 4 and a drive pattern of the propulsion devices 3. For example, a plurality of marine vessel maneuvering patterns may have been prepared for a specific operation of the operation devices 4. The plurality of marine vessel maneuvering patterns may include corresponding information of different drive patterns to a specific operation of the operation devices 4. The drive pattern is a drive pattern of the propulsion devices 3, and is a combination of a plurality of factors that have an effect on the behavior of the hull 2, such as drive/non-drive of each propulsion device 3, the direction of a thrust force, and the magnitude of a thrust force.

The selection information storage section 22 stores selection information to identify a marine vessel maneuvering pattern selected from a plurality of marine vessel maneuvering patterns stored in the marine vessel maneuvering pattern storage section 21. By making reference to the selection information, the currently applied marine vessel maneuvering pattern can be identified. Marine vessel maneuvering patterns are selected, one each for a specific operation of the operation devices 4. Therefore, one marine vessel maneuvering pattern may be selected for each of the plurality of operations of the operation devices 4. The selection information storage section 22 is preferably a memory area of a non-volatile memory (for example, an EEPROM) provided on the control unit 10 so that the stored selection information is not lost even when the power is off.

The control section 23 executes processes based on a control program 20. The control section 23 reads out from the marine vessel maneuvering pattern storage section 21 a marine vessel maneuvering pattern corresponding to selection information stored in the selection information storage section 22. Then, the control section 23, based on the read-out marine vessel maneuvering pattern, outputs a command signal to the propulsion devices 3 according to an operation signal of the operation devices 4. That is, the control section 23, when an operation signal is input from the operation devices 4, generates a command signal to correspond to the operation signal by the selected marine vessel maneuvering pattern. The command signal is provided to the propulsion devices 3, and the propulsion devices 3 are thus activated in accordance with the marine vessel maneuvering pattern to obtain a hull behavior corresponding to an operation of the operation device 4.

The input device 11 includes, for example, a display module 12 and an input module 13, and provides a man-machine interface between an operator and the control unit 10. The display module 12 may be a two-dimensional display unit including a liquid crystal panel. The input module 13 may be either a touch panel disposed on a display screen of the display module 12 or a key input unit. The input device 11 provides a function as a selection device to be operated by an operator to select, for a specific operation, one of the plurality of marine vessel maneuvering patterns stored in the marine vessel maneuvering pattern storage section 21. More specifically, due to the function of the control unit 10, an option for a selectable marine vessel maneuvering pattern is displayed on the display module 12. A user can select the option displayed on the display module 12 by operating the input module 13. Information to identify a marine vessel maneuvering pattern corresponding to the selected option is written in the selection information storage section 22 by the selection information writing section 24.

The selection information writing section 24, when a selecting operation of a pattern for the input device 11 has been performed, in response thereto, writes in the selection information storage section 22 selection information to identify the selected marine vessel maneuvering pattern. That is, the selection information writing section 24 replaces former selection information with new selection information. The selection information writing section 24 maintains selection information of the selection information storage section 22 at a former value and does not perform rewriting thereof unless an operation to select a new marine vessel maneuvering pattern is performed from the input device 11.

The operation device recognition section 28 recognizes the operation devices 4 actually equipped on the marine vessel 1. The operation device recognition section 28 may be programmed to automatically recognize the type of the operation devices 4 based on type identification information generated by the operation devices 4. Moreover, the operation device recognition section 28 may be programmed to automatically recognize the type of the operation devices 4 based on the type of an interface 34A, 34B, 34C through which the operation device 4 is connected to the control unit 10. Moreover, the operation device recognition section 28 may be programmed to recognize the type of the operation devices 4 by obtaining information to identify the type of operation devices 4 that are actually equipped on the marine vessel 1 from an external input device 40. The external input device 40 may be, for example, a computer in which a dedicated tool (software) has been installed. By connecting such an external input device 40 to a communication interface 41 included in the control unit 10 to perform information communication, the control unit 10 (in particular, an operation device recognition section 28) can obtain information to identify the type of the operation devices 4.

The propulsion device recognition section 29 recognizes the propulsion devices 3 actually equipped on the marine vessel 1. The propulsion device recognition section 29 may be programmed to obtain type identification information generated by the propulsion devices 3, and to recognize the type of the propulsion devices 3 based on the identification information. Moreover, the propulsion device recognition section 29 may be programmed to recognize the type of the propulsion devices 3 by obtaining information to identify the type of a propulsion devices 3 that are actually equipped on the marine vessel 1 from the external input device 40.

The marine vessel maneuvering pattern extraction section 26, based on the operation devices 4 and the propulsion devices 3 recognized by the equipment recognition section 25 (operation device recognition section 28 and propulsion device recognition section 29), extracts a selectable marine vessel maneuvering pattern from the plurality of marine vessel maneuvering patterns stored in the marine vessel maneuvering pattern storage section 21. More specifically, a practically feasible marine vessel maneuvering pattern is extracted from the marine vessel maneuvering pattern storage section 21 according to the type of the actually equipped operation devices 4 and the type and number of elements of the actually equipped propulsion devices 3.

An option corresponding to the marine vessel maneuvering pattern extracted by the marine vessel maneuvering pattern extraction section 26 is displayed on the display module 12 of the input device 11, and is selectable by the input module 13. Therefore, a user can, by performing an operation to select a selectable option from the input module 13, reliably select the practically feasible marine vessel maneuvering pattern.

The marine vessel maneuvering pattern rewriting section 27, if a new marine vessel maneuvering pattern is input from the external input device 40, updates marine vessel maneuvering pattern data in the marine vessel maneuvering pattern storage section 21. For example, if marine vessel maneuvering pattern data for using a newly developed propulsion device is created, the marine vessel maneuvering pattern rewriting section 27 can write the new marine vessel maneuvering pattern in the marine vessel maneuvering pattern storage section 21. Accordingly, when a new propulsion device is equipped on the hull 2, marine vessel maneuvering using the new propulsion device becomes possible.

Of the propulsion devices 3, the outboard motors 3A and 3B include ECUs (Electronic Control Units) 45A and 45B, motors 46A and 46B, and shift mechanisms 47A and 47B. The ECUs 45A and 45B receive command signals from the control section 23 of the control unit 10, and based on the command signals, control the operations of the motors 46A and 46B and the shift mechanisms 47A and 47B and the steering units 6A and 6B.

Of the propulsion devices 3, the bow thruster 3C includes, for example, an electric motor 48 serving as a motor and a drive unit 49 to drive the electronic motor 48. The drive unit 49, according to a command signal from the control section 23 of the control unit 10, controls the electric motor 48 to be a stop state, a normal rotation direction driving state, or a reverse rotation direction driving state.

In this manner, as a result of the propulsion devices 3 (3A to 3C) being driven in accordance with a marine vessel maneuvering pattern, a marine vessel behavior corresponding to the marine vessel maneuvering pattern is achieved.

Figure 4:
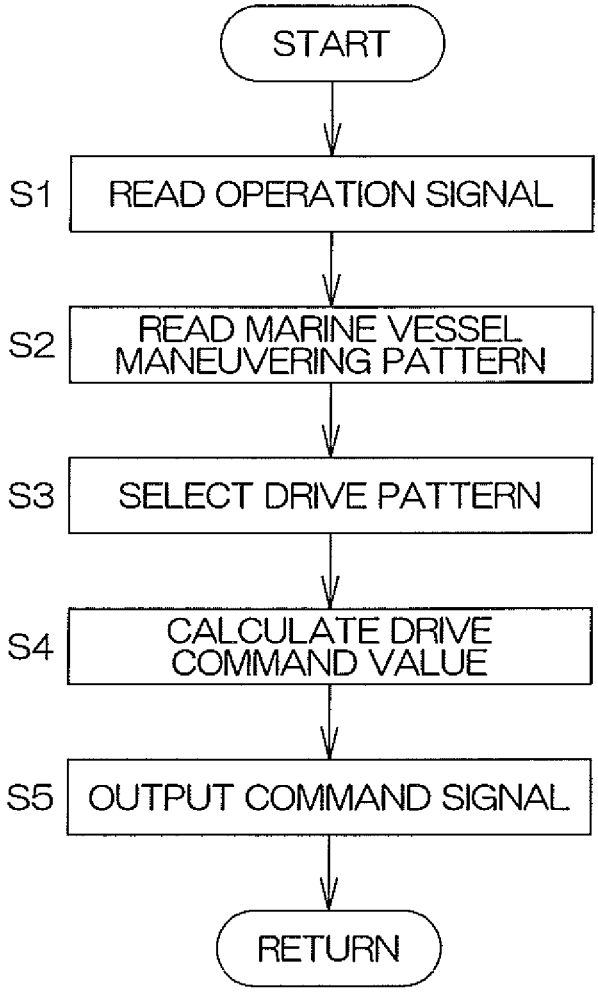
FIG. 4 is a flowchart for explaining a control operation of the marine vessel propulsion control device.

FIG. 4 is a flowchart for explaining a non-limiting operation example of the control section 23. The control section 23 reads an operation signal output by the operation device 4 (step S1). Then, the control section 23 reads a marine vessel maneuvering pattern corresponding to selection information stored in the selection information storage section 22 from the marine vessel maneuvering pattern storage section 21 (step S2). Further, the control section 23 selects a drive pattern corresponding to the operation signal from the marine vessel maneuvering pattern (step S3), and determines a drive command value based on the drive pattern (step S4). The drive command value is provided to the propulsion devices 3 as a command signal (step S5). The drive command value may be, for example, the throttle opening degree of an engine as a non-limiting example of the motor, the steering angles of the steering units 6A and 6B, and the rotating direction and output (corresponding to the rotating speed) of the bow thruster 3C.

Figure 5:
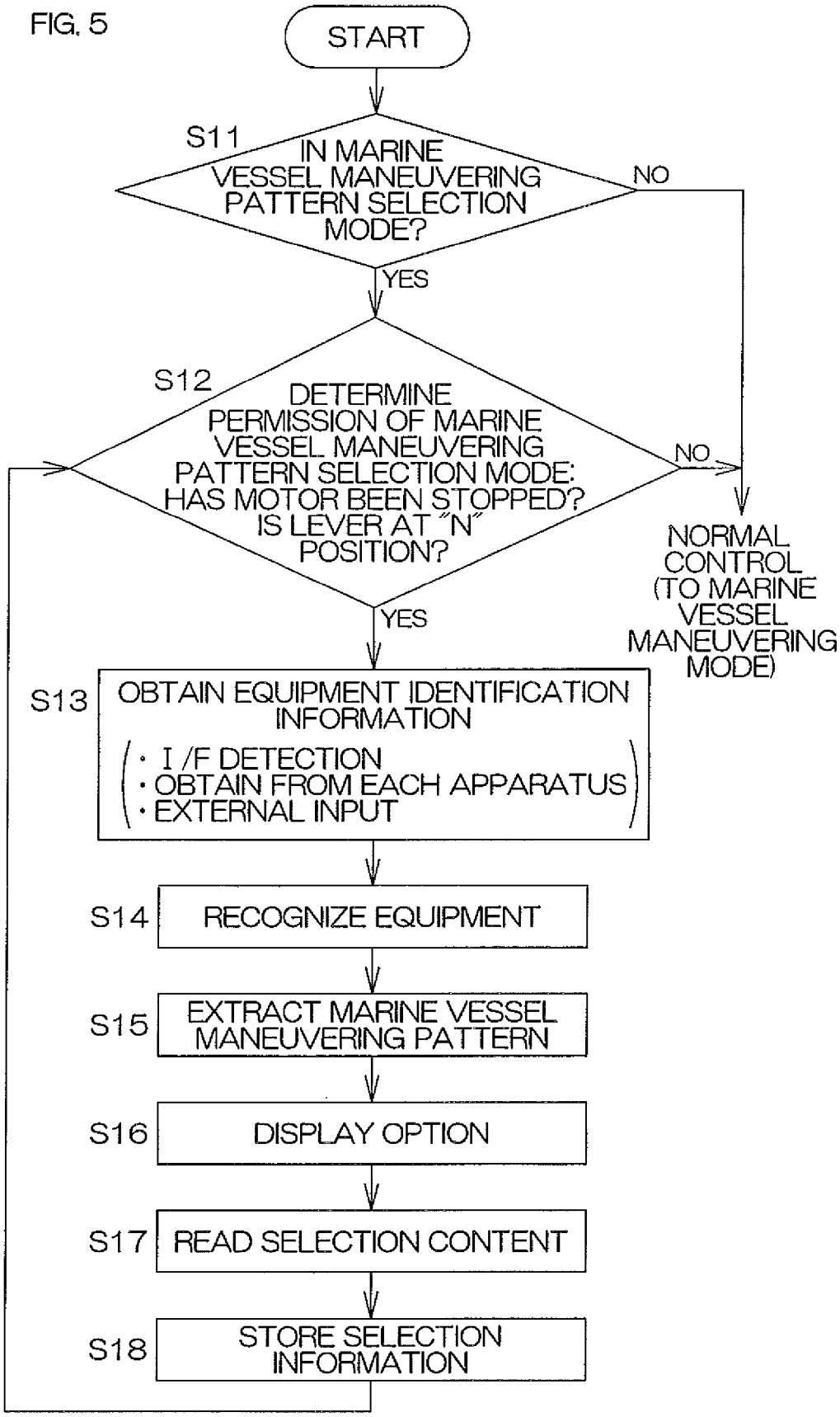
FIG. 5 is a flowchart for explaining a selection of a marine vessel maneuvering pattern.

FIG. 5 is a flowchart for explaining processes executed by control section 23 related to selection of a marine vessel maneuvering pattern. By performing a predetermined mode switching operation in the input device 11, the mode of the control section 23 is switched between a marine vessel maneuvering mode (normal mode) and a marine vessel maneuvering pattern selection mode. The marine vessel maneuvering mode is a mode (refer to FIG. 4) to control the propulsion devices 3 according to an operation signal from the operation devices 4. On the other hand, the marine vessel maneuvering pattern selection mode is a mode that selects a marine vessel maneuvering pattern by an operation of the input device 11.

The control section 23, if not in the marine vessel maneuvering pattern selection mode (step S11: NO), executes an operation following the marine vessel maneuvering mode (FIG. 4). If the marine vessel maneuvering pattern selection mode is selected (step S11: YES), the control section 23 determines whether to permit the marine vessel maneuvering pattern selection mode (step S12). Specifically, the control section 23 judges whether a condition for permitting the marine vessel maneuvering pattern selection mode has been satisfied. The condition for permitting the marine vessel maneuvering pattern selection mode may include, for example, that the motors 46A and 46B and the electric motor 48 have all been stopped. The condition for permitting the marine vessel maneuvering pattern selection mode may further include that the lever position of the output adjustment unit 4B of the operation devices 4 is at a neutral position. If the condition for permitting the marine vessel maneuvering pattern selection mode is not satisfied (step S12: NO), the control section 23 automatically switches its operation mode to the marine vessel maneuvering mode.

If the condition for permitting the marine vessel maneuvering pattern selection mode has been satisfied (step S12: YES), the control section 23 obtains equipment identification information (step S13). The equipment identification information is information to identify the equipment (propulsion devices 3 and operation devices 4) actually provided on the marine vessel 1. The equipment identification information may be the type of interfaces to which the propulsion devices 3 and/or the operation devices 4 are connected. That is, when the type of an interface varies according to the type of equipment, the control section 23 can identify the equipment by scanning the interfaces to detect whether there is a connection of an apparatus to each interface. Moreover, the control section 23 may obtain equipment identification information from an apparatus connected thereto. That is, when the propulsion devices 3 and/or the operation devices 4 have a function of generating equipment identification information, it suffices to obtain equipment identification information generated from each apparatus. Further, the control section 23 may obtain equipment identification information input (for example, manually input) from the external input device 40. The equipment identification information input from the external input device 40 may have been stored in a memory (preferably, a non-volatile memory) included in the control unit 10. In this case, it suffices that the control section 23 reads out equipment identification information from the memory.

Then, the control section 23, based on the equipment identification information obtained as in the above, recognizes the type and number of equipment connected to the control unit 10, that is, elements of the operation device 4 and the propulsion device 3 actually equipped on the marine vessel 1 (step S14).

The control section 23, further, based on the recognized equipment, searches the memory content of the marine vessel maneuvering pattern storage section 21, and extracts an applicable marine vessel maneuvering pattern from a plurality of marine vessel maneuvering patterns stored in the marine vessel maneuvering pattern storage section 21 (step S15). Then, the control section 23 causes an option corresponding to the extracted marine vessel maneuvering pattern to be displayed on the display module 12 of the input device 11 such that a selecting operation is available (step S16). An option(s) corresponding to a non-extracted marine vessel maneuvering pattern(s) may not be displayed on the display module 12 and may be displayed such that a selecting operation is not available. In either case, the option(s) that can be selected by an operator is only an option(s) corresponding to actual equipment.

The operator, by operating the input module 13, performs an operation to select one of the options (marine vessel maneuvering patterns) displayed. The control section 23 reads the selection content by the operation (step S17). Then, the control section 23 stores selection information indicating a marine vessel maneuvering pattern corresponding to the read selection content in the selection information storage section 22 (step S18). Subsequently, the processes from step S11 are repeated.

The marine vessel maneuvering pattern storage section 21 may have stored, for example, with regard to the propulsion devices 3 and the auxiliary operation unit 4C, marine vessel maneuvering patterns corresponding to the following variations.

Variations of the propulsion devices 3

The number of outboard motors is one, or two or more.

Presence or absence of a bow thruster

Variations of the auxiliary operation unit 4C

Presence or absence of a lateral lever unit

Presence or absence of a lateral dual lever unit

Presence or absence of a joystick unit

Figure 6:
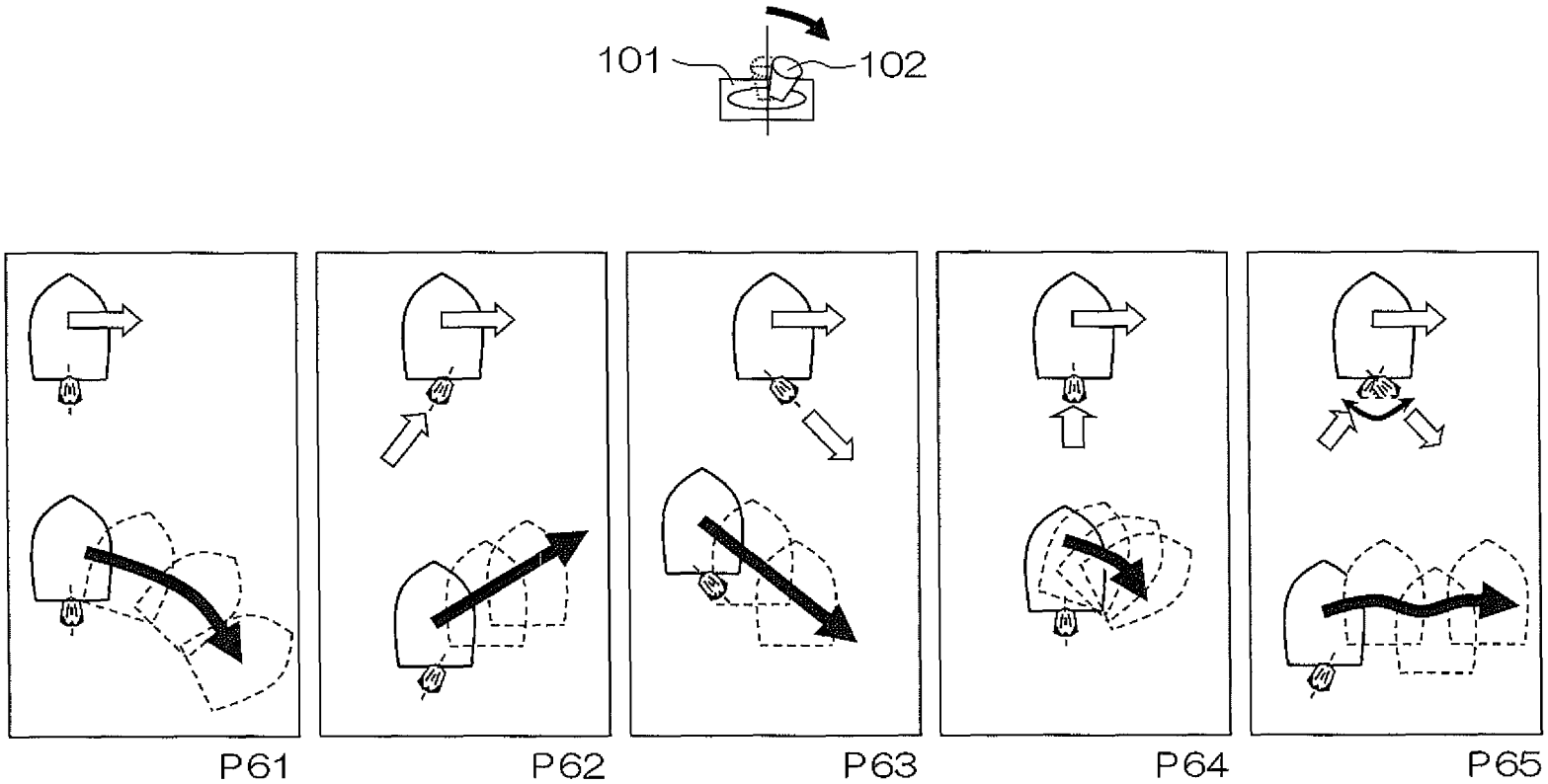
FIG. 6 shows a non-limiting example of a marine vessel maneuvering pattern group when a bow thruster and one outboard motor are provided as propulsion devices, and a lateral lever unit is provided as an auxiliary operation unit.

FIG. 6 shows a non-limiting example of a marine vessel maneuvering pattern group when a bow thruster and one outboard motor are provided as propulsion devices, and a lateral lever unit 101 is provided as an auxiliary operation unit 4C. The lateral lever unit 101 is an operation unit including a lateral lever 102 that is tiltable only in the left-right direction. In FIG. 6, as shown in the upper section of the same figure, a non-limiting example of a marine vessel maneuvering pattern when the lateral lever 102 is tilted to the right side is shown. More specifically, a plurality of non-limiting examples of a drive pattern that correspond to an operation to tilt the lateral lever 102 to the right side and a hull behavior corresponding thereto are shown in a plurality of frames in the lower section of FIG. 6, respectively. The drive pattern is shown at an upper portion in each frame, and the hull behavior is shown at a lower portion in each frame (hereinafter, also in other drawings, a drive pattern and hull behavior representing each marine vessel maneuvering pattern are likewise illustrated in each frame). A combination of a tilting operation in the left-right direction of the lateral lever 102 and one drive pattern defines one marine vessel maneuvering pattern. Drive patterns and hull behaviors when the lateral lever 102 is tilted to the left side are left-right symmetric with the drive patterns and hull behaviors of the respective marine vessel maneuvering patterns shown in FIG. 6.

The drive pattern resulting from the marine vessel maneuvering pattern P61 is a drive pattern to cause the bow thruster to generate a thrust force in a tilting direction of the lateral lever 102 and not to cause the outboard motor to generate a thrust force. In this case, the hull moves along a circular arc in the tilting direction of the lateral lever 102 while turning about the stem (hereinafter "stem turning") in the tilting direction of the lateral lever 102. The thrust force generated by the bow thruster may be determined according to the tilt amount from the neutral position of the lateral lever 102.

The drive pattern resulting from the marine vessel maneuvering pattern P62 is a drive pattern to cause the bow thruster to generate a thrust force in a tilting direction of the lateral lever 102 and to cause the outboard motor to generate a thrust force in an obliquely forward direction corresponding to the tilting direction of the lateral lever 102. In this case, the hull moves (without turning) in an obliquely forward direction corresponding to the tilting direction of the lateral lever 102 with its bow direction substantially maintained. The thrust forces generated by the bow thruster and outboard motor may be determined according to the tilt amount from the neutral position of the lateral lever 102.

The drive pattern resulting from the marine vessel maneuvering pattern P63 is a drive pattern to cause the bow thruster to generate a thrust force in a tilting direction of the lateral lever 102 and to cause the outboard motor to generate a thrust force in an obliquely rearward direction corresponding to the tilting direction of the lateral lever 102. In this case, the hull moves (without turning) in an obliquely rearward direction corresponding to the tilting direction of the lateral lever 102 with its bow direction substantially maintained. The thrust forces generated by the bow thruster and outboard motor may be determined according to the tilt amount from the neutral position of the lateral lever 102.

The drive pattern resulting from the marine vessel maneuvering pattern P64 is a drive pattern to cause the bow thruster to generate a thrust force in a tilting direction of the lateral lever 102 and to cause the outboard motor to generate a forward thrust force. In this case, the hull undergoes stem turning in the tilting direction of the lateral lever 102, remaining substantially in that position (on-the-spot stem turning). The thrust forces generated by the bow thruster and outboard motor may be determined according to the tilt amount from the neutral position of the lateral lever 102. For example, the thrust force of the outboard motor may be determined, when the hull undergoes stem turning due to a thrust force of the bow thruster and the hull attempts to move rearward simultaneously (refer to the marine vessel maneuvering pattern P61), so as to prevent the rearward hull movement.

The drive pattern resulting from the marine vessel maneuvering pattern P65 is a drive pattern to cause the bow thruster to generate a thrust force in a tilting direction of the lateral lever 102 and to cause the outboard motor to generate a thrust force in obliquely forward and obliquely rearward directions corresponding to the tilting direction of the lateral lever 102. More specifically, the outboard motor is, by being turned to the left and right, controlled alternatively into a state of generating an obliquely forward thrust force and a state of generating an obliquely rearward thrust force. Accordingly, the hull moves in (without turning) straight sideways in the direction in which the lateral lever 102 has been tilted, with its bow direction substantially maintained. The thrust forces generated by the bow thruster and outboard motor may be determined according to the tilt amount from the neutral position of the lateral lever 102.

Figure 7:
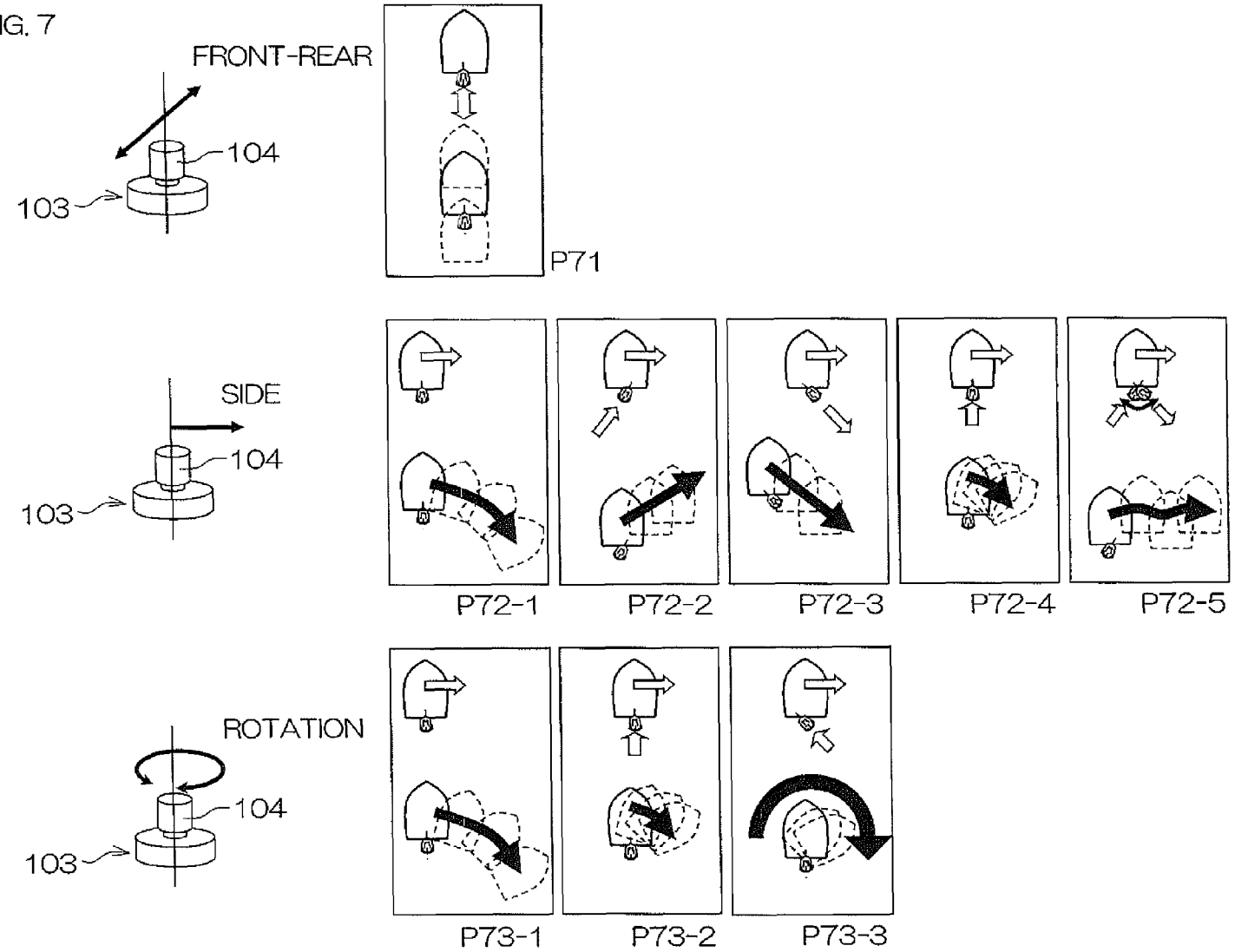
FIG. 7 shows a non-limiting example of a marine vessel maneuvering pattern group when a bow thruster and one outboard motor are provided as propulsion devices, and a joystick unit is provided as an auxiliary operation unit.

FIG. 7 shows a non-limiting example of a marine vessel maneuvering pattern group when a bow thruster and one outboard motor are provided as propulsion devices, and a joystick unit is provided as an auxiliary operation unit 4C.

The joystick unit 103 is an operation unit including a lever 104 that is tiltable in any direction from the neutral position and turnable about an axis.

The marine vessel maneuvering pattern P71 is a marine vessel maneuvering pattern that corresponds to a forward or rearward tilting operation of the lever 104 as shown on the left side thereof. That is, when the lever 104 is tilted forward, no thrust force is generated from the bow thruster and a forward thrust force is generated from the outboard motor. When the lever 104 is tilted rearward, no thrust force is generated from the bow thruster and a rearward thrust force is generated from the outboard motor. The thrust force generated by the outboard motor may be determined according to the tilt amount from the neutral position of the lever 104.

The marine vessel maneuvering patterns P72-1 to P72-5 are examples of a marine vessel maneuvering pattern that correspond to an operation to tilt the lever 104 to the right side as shown on the left side thereof. More specifically, non-limiting examples of a drive pattern and hull behavior that correspond to an operation to tilt the lever 104 to the right side are shown. A combination of a tilting operation in the left-right direction of the lever 104 and one drive pattern defines one marine vessel maneuvering pattern. Drive patterns and hull behaviors when the lever 104 is tilted to the left side are left-right symmetric with the drive patterns and hull behaviors of the respective marine vessel maneuvering patterns shown in FIG. 7.

As can be immediately understood from a comparison with FIG. 6, the marine vessel maneuvering patterns P72-1 to P72-5 are substantially the same as the marine vessel maneuvering patterns P61 to P65. Therefore, detailed description thereof will be omitted.

When the lever 104 is tilted in an oblique direction, there may be provided a marine vessel maneuvering pattern by synthesizing the marine vessel maneuvering pattern P71 with any of the marine vessel maneuvering patterns P72-1 to P72-5. More specifically, the tilt amount of the lever 104 may be broken down into a front-rear direction component and a left-right direction component to determine the magnitude of the thrust force of the outboard motor according to the front-rear direction component and to determine the magnitude of the thrust force of the bow thruster according to the left-right direction component.

The marine vessel maneuvering patterns P73-1 to P73-3 are non-limiting examples of a marine vessel maneuvering pattern that correspond to an operation to turn the lever 104 clockwise as shown on the left side thereof. More specifically, non-limiting examples of a drive pattern that correspond to an operation to turn the lever 104 clockwise and a hull behavior corresponding thereto are shown. A combination of a counterclockwise/clockwise turning operation of the lever 104 and one drive pattern defines one marine vessel maneuvering pattern. Drive patterns and hull behaviors when the lever 104 is turned counterclockwise are left-right symmetric with the drive patterns and hull behaviors of the respective marine vessel maneuvering patterns shown in FIG. 7.

The drive pattern resulting from the marine vessel maneuvering pattern P73-1 is a drive pattern to cause the bow thruster to generate a thrust force in a turning direction of the lever 104 and not to cause the outboard motor to generate a thrust force. In this case, the hull moves along a circular arc in the turning direction of the lever 104 while stem turning in the turning direction of the lever 104. The thrust force generated by the bow thruster may be determined according to the turning amount from the neutral position of the lever 104.

The drive pattern resulting from the marine vessel maneuvering pattern P73-2 is a drive pattern to cause the bow thruster to generate a thrust force in a turning direction of the lever 104 and to cause the outboard motor to generate a forward thrust force. In this case, the hull undergoes stem turning in the lever turning direction of the lever 104, remaining substantially in that position (on-the-spot stem turning). The thrust forces generated by the bow thruster and outboard motor may be determined according to the turning amount from the neutral position of the lever 104.

The drive pattern resulting from the marine vessel maneuvering pattern P73-3 is a drive pattern to cause the bow thruster to generate a thrust force in a turning direction of the lever 104 and to cause the outboard motor to generate a thrust force in an obliquely forward direction opposite to the turning direction of the lever 104. In this case, the hull undergoes stem turning in the lever turning direction, remaining substantially in that position (on-the-spot stem turning). The thrust forces generated by the bow thruster and outboard motor may be determined according to the turning amount from the neutral position of the lever. In the marine vessel maneuvering pattern P73-3, a hull movement can be minimized more than in the marine vessel maneuvering pattern P73-2.

Figure 8:
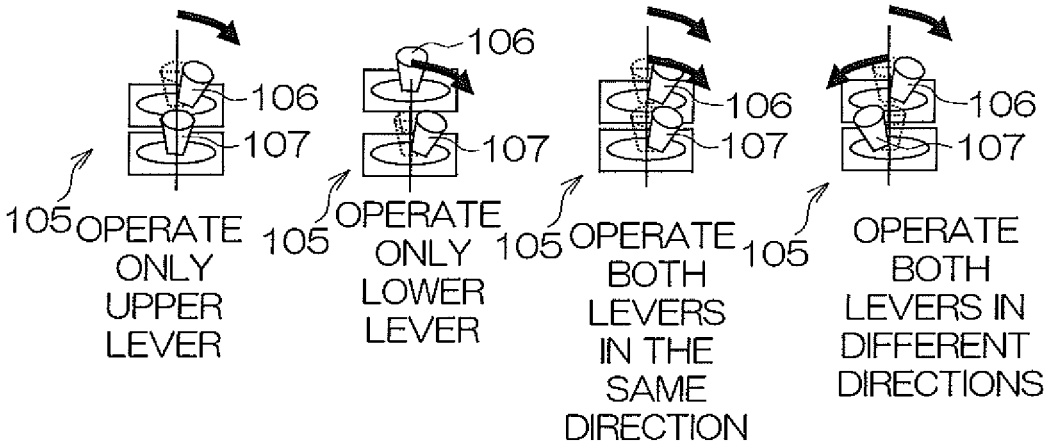
FIG. 8 shows a non-limiting example of a marine vessel maneuvering pattern group when a bow thruster and one outboard motor are provided as propulsion devices, and a lateral dual lever unit is provided as an auxiliary operation unit.
Figure 8:
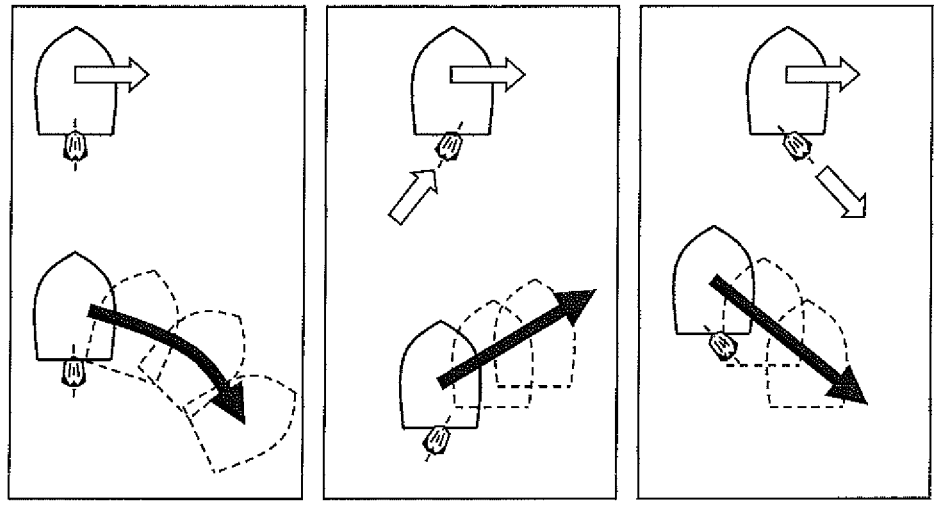
Figure 8:
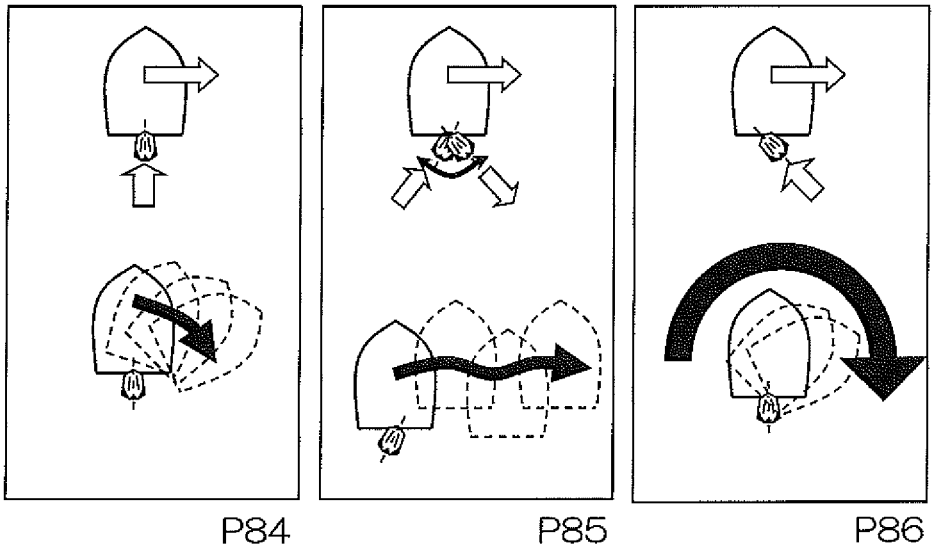

FIG. 8 shows a non-limiting example of a marine vessel maneuvering pattern group when a bow thruster and one outboard motor are provided as propulsion devices, and a lateral dual lever unit is provided as an auxiliary operation unit 4C. The lateral dual lever unit 105 is an operation device for which two lateral levers 106 and 107 that are respectively tiltable to the left and right are disposed as a front and rear pair. For the sake of convenience, one lateral lever disposed at a front side of the hull of the two lateral levers is referred to as an "upper lever 106," and the other lever is referred to as a "lower lever 107."

The operations of the lateral dual lever unit 105 are, as shown in the upper section of FIG. 8, classified as follows.

Operate only upper lever: Operation to tilt only the upper lever to the right or left.

Operate only lower lever: Operation to tilt only the lower lever to the right or left.

Operate both levers in the same direction: Operation to tilt the upper and lower levers in the same right or left direction.

Operate both levers in different directions: Operation to tilt one of the upper and lower levers in the right direction and tilt the other lever in the left direction.

To each of the operations of the lateral dual lever unit 105 as in the above, for example, one marine vessel maneuvering pattern selected from the marine vessel maneuvering patterns P81 to P86 can be selected. The marine vessel maneuvering patterns P81 to P86 correspond to hull behaviors to move or undergo stem turning in the right direction, but there are also prepared marine vessel maneuvering patterns corresponding to hull behaviors to move or undergo stem turning in the left direction, as well. Drive patterns and hull behaviors in the case of marine vessel maneuvering patterns corresponding to the left direction are left-right symmetric with the drive patterns and hull behaviors of the respective marine vessel maneuvering patterns shown in FIG. 8.

As can be immediately understood from a comparison with FIG. 6, the marine vessel maneuvering patterns P81 to P85 are the same as the marine vessel maneuvering patterns P61 to P65. Moreover, as can be immediately understood from a comparison with FIG. 7, the marine vessel maneuvering pattern P86 is the same as the marine vessel maneuvering pattern P73-3. Therefore, detailed description of the respective marine vessel maneuvering patterns will be omitted.

For example, for the "operate only upper lever," the marine vessel maneuvering patterns P81, P82, P84, and P85 may be the selectable options. Moreover, for the "operate only lower lever," the marine vessel maneuvering patterns P81, P83, P84, and P85 may be the selectable options. Further, for the "operate both levers in the same direction," the marine vessel maneuvering patterns P81 to P85 may be the selectable options. These marine vessel maneuvering patterns may be, for example, options for an operation to tilt the lever in the right direction. As options for an operation to tilt the lever in the left direction, it is preferable to use marine vessel maneuvering patterns that are left-right symmetric with the marine vessel maneuvering patterns P81 to P85. For the "operate both levers in different directions," the marine vessel maneuvering patterns P81, P84, and P86 may be the selectable options. These marine vessel maneuvering patterns may be, for example, options for an operation to tilt the upper lever 106 in the right direction and tilt the lower lever 107 in the left direction. As options for an operation to tilt the upper lever 106 in the left direction and tilt the lower lever 107 in the right direction, it is preferable to use marine vessel maneuvering patterns that are left-right symmetric with the marine vessel maneuvering patterns P81, P84, and P86.

Figure 9:
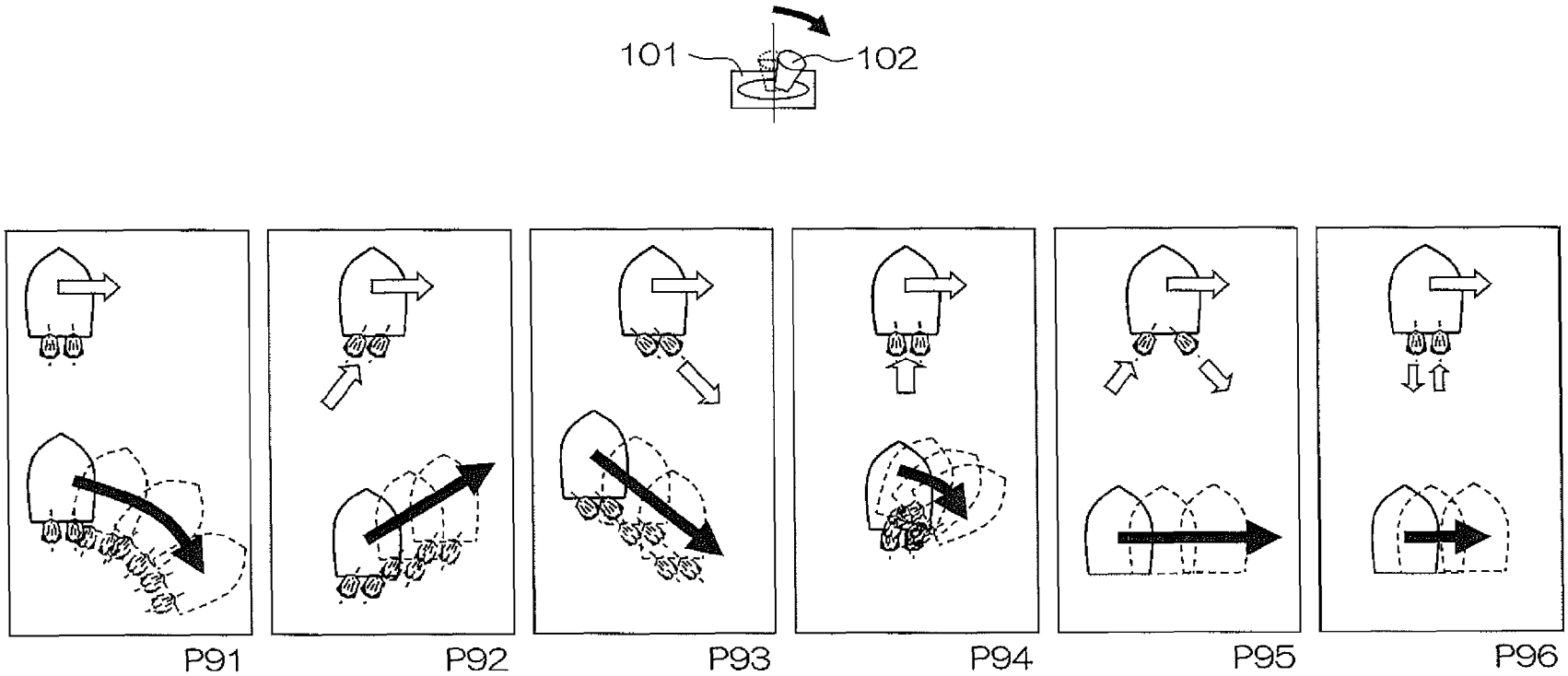
FIG. 9 shows a non-limiting example of a marine vessel maneuvering pattern group when a bow thruster and two outboard motors are provided as propulsion devices, and a lateral lever unit is provided as an auxiliary operation unit.

FIG. 9 shows a non-limiting example of a marine vessel maneuvering pattern group when a bow thruster and two outboard motors are provided as propulsion devices, and the lateral lever unit 101 is provided as an auxiliary operation unit 4C. In FIG. 9, non-limiting examples of a marine vessel maneuvering pattern when the lateral lever 102 is tilted to the right side as shown in the upper section of the same figure are shown in a plurality of frames in the lower section of the same figure. More specifically, a plurality of non-limiting examples of a drive pattern that correspond to an operation to tilt the lateral lever 102 to the right side and a hull behavior corresponding thereto are shown. Drive patterns and hull behaviors when the lateral lever 102 is tilted to the left side are left-right symmetric with the drive patterns and hull behaviors of the respective marine vessel maneuvering patterns shown in FIG. 9.

The drive pattern resulting from the marine vessel maneuvering pattern P91 is a drive pattern to cause the bow thruster to generate a thrust force in a tilting direction of the lateral lever 102 and not to cause either of the two outboard motors to generate a thrust force. In this case, the hull moves along a circular arc in the tilting direction of the lateral lever 102 while stem turning in the tilting direction of the lateral lever 102. The thrust force generated by the bow thruster may be determined according to the tilt amount from the neutral position of the lateral lever 102.

The drive pattern resulting from the marine vessel maneuvering pattern P92 is a drive pattern to cause the bow thruster to generate a thrust force in a tilting direction of the lateral lever 102 and to cause the two outboard motors to generate thrust forces in an obliquely forward direction corresponding to the tilting direction of the lateral lever 102. In this case, the hull moves (without turning) in an obliquely forward direction corresponding to the tilting direction of the lateral lever 102 with its bow direction substantially maintained. The thrust forces generated by the bow thruster and outboard motors may be determined according to the tilt amount from the neutral position of the lateral lever 102.

The drive pattern resulting from the marine vessel maneuvering pattern P93 is a drive pattern to cause the bow thruster to generate a thrust force in a tilting direction of the lateral lever 102 and to cause the two outboard motors to generate thrust forces in an obliquely rearward direction corresponding to the tilting direction of the lateral lever 102. In this case, the hull moves (without turning) in an obliquely rearward direction corresponding to the tilting direction of the lateral lever 102 with its bow direction substantially maintained. The thrust forces generated by the bow thruster and outboard motors may be determined according to the tilt amount from the neutral position of the lateral lever 102.

The drive pattern resulting from the marine vessel maneuvering pattern P94 is a drive pattern to cause the bow thruster to generate a thrust force in a tilting direction of the lateral lever 102 and to cause the two outboard motors to generate forward thrust forces. In this case, the hull undergoes stem turning in the tilting direction of the lateral lever 102, remaining substantially in that position (on-the-spot stem turning). The thrust forces generated by the bow thruster and outboard motors may be determined according to the tilt amount from the neutral position of the lateral lever 102. For example, the thrust forces of the outboard motors may be determined, when the hull undergoes stem turning due to a thrust force of the bow thruster and the hull attempts to move rearward simultaneously (refer to the marine vessel maneuvering pattern P91), so as to prevent the rearward hull movement.

The drive pattern resulting from the marine vessel maneuvering pattern P95 is a drive pattern to cause the bow thruster to generate a thrust force in a tilting direction of the lateral lever 102 and to cause the two outboard motors to generate thrust forces in obliquely forward and obliquely rearward directions corresponding to the tilting direction of the lateral lever 102, respectively. More specifically, of the left and right outboard motors, the outboard motor that is on the side of the tilting direction of the lateral lever 102 is controlled so as to generate a thrust force in an obliquely rearward direction corresponding to the tilting direction of the lateral lever 102, and the remaining other outboard motor is controlled so as to generate a thrust force in an obliquely forward direction corresponding to the tilting direction of the lateral lever 102. The steering angles of the two outboard motors are controlled so that lines of action of the thrust forces of the left and right outboard motors intersect inside the hull in a plan view. Accordingly, the hull moves straight sideways in the direction in which the lateral lever 102 has been tilted, with its bow direction substantially maintained. The thrust forces generated by the bow thruster and outboard motors may be determined according to the tilt amount from the neutral position of the lateral lever 102.

The drive pattern resulting from the marine vessel maneuvering pattern P96 is a drive pattern to cause the bow thruster to generate a thrust force in a tilting direction of the lateral lever 102 and to cause the two outboard motors to generate forward and rearward thrust forces, respectively. More specifically, of the left and right outboard motors, the outboard motor that is on the side of the tilting direction of the lateral lever 102 is controlled so as to generate a forward thrust force, and the remaining other outboard motor is controlled so as to generate a rearward thrust force. Accordingly, a stem turning moment to compensate for a stem turning moment (refer to the marine vessel maneuvering pattern P91) provided to the hull by a thrust force of the bow thruster is provided to the hull by the two outboard motors. As a result, the hull moves straight sideways in the direction in which the lateral lever 102 has been tilted, with its bow direction substantially maintained. The thrust forces generated by the bow thruster and outboard motors may be determined according to the tilt amount from the neutral position of the lateral lever 102. The marine vessel maneuvering pattern P95 results in a larger thrust force in the lateral direction than that of the marine vessel maneuvering pattern P96. This is because, in the marine vessel maneuvering pattern P95, the thrust forces of the outboard motors also have lateral components.

Figure 10:
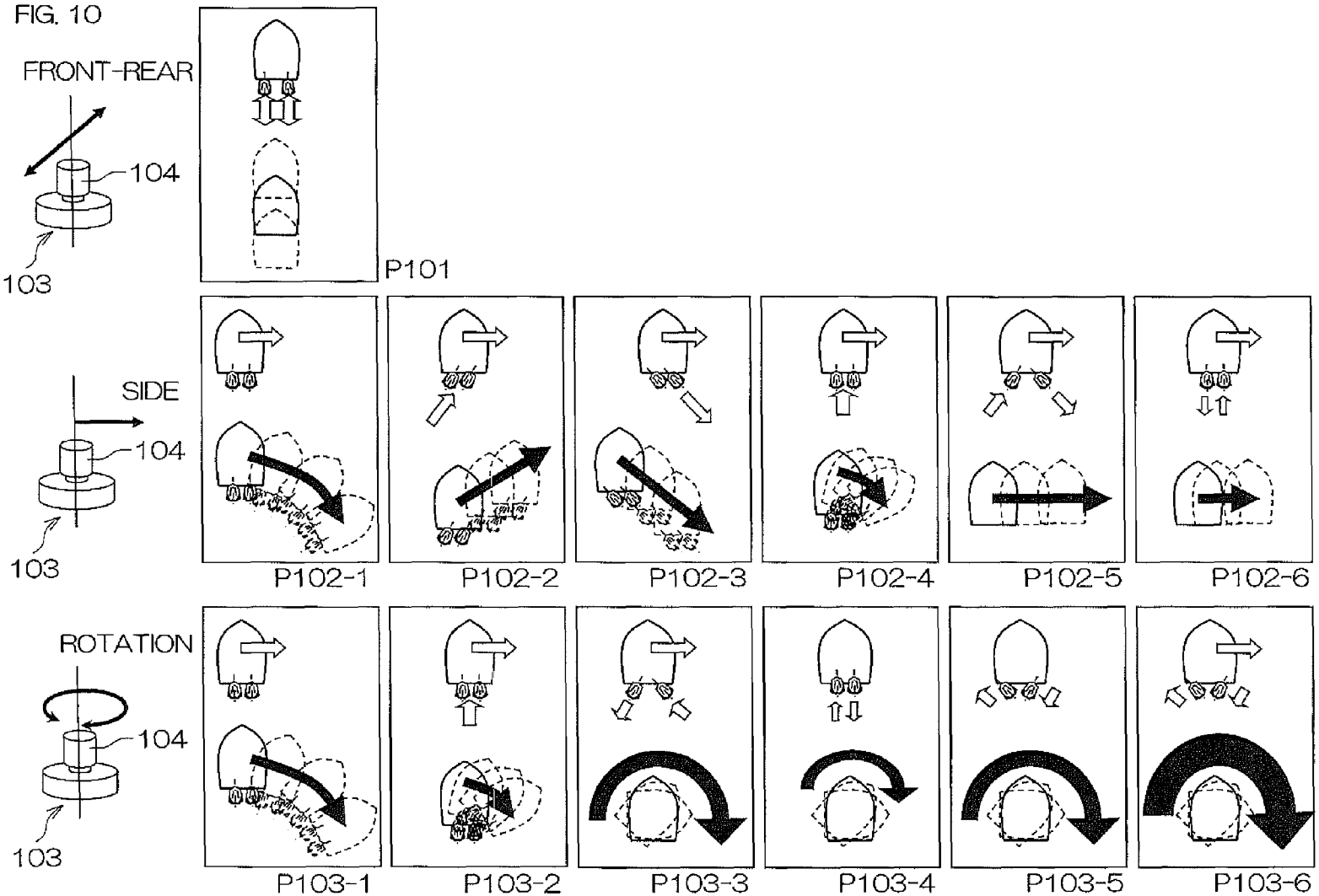
FIG. 10 shows a non-limiting example of a marine vessel maneuvering pattern group when a bow thruster and two outboard motors are provided as propulsion devices, and a joystick unit is provided as an auxiliary operation unit.

FIG. 10 shows a non-limiting example of a marine vessel maneuvering pattern group when a bow thruster and two outboard motors are provided as propulsion devices, and the joystick unit 103 is provided as an auxiliary operation unit 4C.

The marine vessel maneuvering pattern P101 is a marine vessel maneuvering pattern that corresponds to a forward or rearward tilting operation of the lever 104 as shown on the left side thereof. That is, when the lever 104 is tilted forward, no thrust force is generated from the bow thruster and forward thrust forces are generated from the two outboard motors. When the lever 104 is tilted rearward, no thrust force is generated from the bow thruster and rearward thrust forces are generated from the two outboard motors. The thrust forces generated by the outboard motors may be determined according to the tilt amount from the neutral position of the lever 104.

The marine vessel maneuvering patterns P102-1 to P102-6 are non-limiting examples of a marine vessel maneuvering pattern that correspond to an operation to tilt the lever 104 to the right side as shown on the left side thereof. More specifically, non-limiting examples of a drive pattern and hull behavior that correspond to an operation to tilt the lever 104 to the right side are shown. A combination of a tilting operation in the left-right direction of the lever 104 and one drive pattern defines one marine vessel maneuvering pattern. Drive patterns and hull behaviors when the lever 104 is tilted to the left side are left-right symmetric with the drive patterns and hull behaviors of the respective marine vessel maneuvering patterns shown in FIG. 10.

As can be immediately understood from a comparison with FIG. 9, the marine vessel maneuvering patterns P102-1 to P102-6 are the same as the marine vessel maneuvering patterns P91 to P96. Therefore, detailed description thereof will be omitted.

When the lever 104 is tilted in an oblique direction, there may be provided a marine vessel maneuvering pattern by synthesizing the marine vessel maneuvering pattern P101 with any of the marine vessel maneuvering patterns P102-1 to P102-6. More specifically, the tilt amount of the lever 104 may be broken down into a front-rear direction component and a left-right direction component to determine the magnitude of the thrust forces of the outboard motors according to the front-rear direction component and determine the magnitude of the thrust force of the bow thruster according to the left-right direction component.

The marine vessel maneuvering patterns P103-1 to P103-6 are non-limiting examples of a marine vessel maneuvering pattern that correspond to an operation to turn the lever 104 clockwise as shown on the left side thereof. More specifically, non-limiting examples of a drive pattern that correspond to an operation to turn the lever 104 clockwise and a hull behavior corresponding thereto are shown. A combination of a counterclockwise/clockwise turning operation of the lever 104 and one drive pattern defines one marine vessel maneuvering pattern. Drive patterns and hull behaviors when the lever 104 is turned counterclockwise are left-right symmetric with the drive patterns and hull behaviors of the respective marine vessel maneuvering patterns shown in FIG. 10.

The drive pattern resulting from the marine vessel maneuvering pattern P103-1 is a drive pattern to cause the bow thruster to generate a thrust force in a turning direction of the lever 104 and not to cause either of the two outboard motors to generate a thrust force. In this case, the hull moves along a circular arc in the turning direction of the lever 104 while stem turning in the turning direction of the lever 104. The thrust force generated by the bow thruster may be determined according to the turning amount from the neutral position of the lever 104.

The drive pattern resulting from the marine vessel maneuvering pattern P103-2 is a drive pattern to cause the bow thruster to generate a thrust force in a turning direction of the lever 104 and to cause the two outboard motors to generate forward thrust forces. In this case, the hull undergoes stem turning in the turning direction of the lever 104, remaining substantially in that position (on-the-spot stem turning). The thrust forces generated by the bow thruster and outboard motors may be determined according to the turning amount from the neutral position of the lever 104.

The drive pattern resulting from the marine vessel maneuvering pattern P103-3 is a drive pattern to cause the bow thruster to generate a thrust force in a turning direction of the lever 104 and to cause the two outboard motors to generate thrust forces in obliquely forward and obliquely rearward directions opposite to the turning direction of the lever 104, respectively. More specifically, from an outboard motor that is on the side of the turning direction (in the case of a clockwise turn, the right side, and in the case of a counterclockwise turn, the left side) of the lever 104, a thrust force in an obliquely forward direction corresponding to a direction opposite to the turning direction of the lever 104 is generated, and from the other outboard motor, a thrust force in an obliquely rearward direction corresponding to a direction opposite to the turning direction of the lever 104 is generated. Lines of action of the thrust forces of the two outboard motors intersect inside the hull in a plan view. If the intersection of the lines of action is located at the rear side of the hull further than a thrust force's line of action of the bow thruster, the thrust force of the bow thruster and the resultant force of the thrust forces of the two outboard motors both provide a moment in the turning direction of the lever 104 to the hull. Accordingly, the hull undergoes stem turning on the spot. The thrust forces generated by the bow thruster and outboard motors may be determined according to the turning amount from the neutral position of the lever 104.

The drive pattern resulting from the marine vessel maneuvering pattern P103-4 does not cause the bow thruster to generate a thrust force, and of the left and right outboard motors, the outboard motor that is on the side of the turning direction of the lever 104 is controlled so as to generate a rearward thrust force, and the remaining other outboard motor is controlled so as to generate a forward thrust force. Accordingly, the left and right outboard motors provide a couple of forces to the hull, so that the hull undergoes stem turning on the spot in the turning direction of the lever 104. The moment provided to the hull is larger with the marine vessel maneuvering pattern P103-3. The thrust forces generated by the outboard motors may be determined according to the turning amount from the neutral position of the lever 104.

The drive pattern resulting from the marine vessel maneuvering pattern P103-5 does not cause the bow thruster to generate a thrust force, and of the left and right outboard motors, the outboard motor that is on the side of the turning direction of the lever 104 is controlled so as to generate a thrust force in an obliquely rearward direction corresponding to an opposite direction to the lever turning direction, and the remaining other outboard motor is controlled so as to generate a thrust force in an obliquely forward direction corresponding to an opposite side to the turning direction of the lever 104. Lines of action of the thrust forces generated by the two outboard motors intersect, in a plan view, in the rear of the hull. Accordingly, the left and right outboard motors provide a moment in the turning direction of the lever 104 to the hull, so that the hull undergoes stem turning on the spot in the turning direction of the lever 104. The moment provided to the hull is larger than that with the marine vessel maneuvering pattern P103-4. The thrust generated by the outboard motors may be determined according to the turning amount from the neutral position of the lever 104.

The drive pattern resulting from the marine vessel maneuvering pattern P103-6 is a drive pattern to cause the bow thruster to generate a thrust force in the turning direction of the lever 104, in addition to that of the marine vessel maneuvering pattern P103-5. Accordingly, a larger stem turning moment is provided to the hull. The thrust forces generated by the bow thruster and outboard motors may be determined according to the turning amount from the neutral position of the lever 104.

Figure 11:
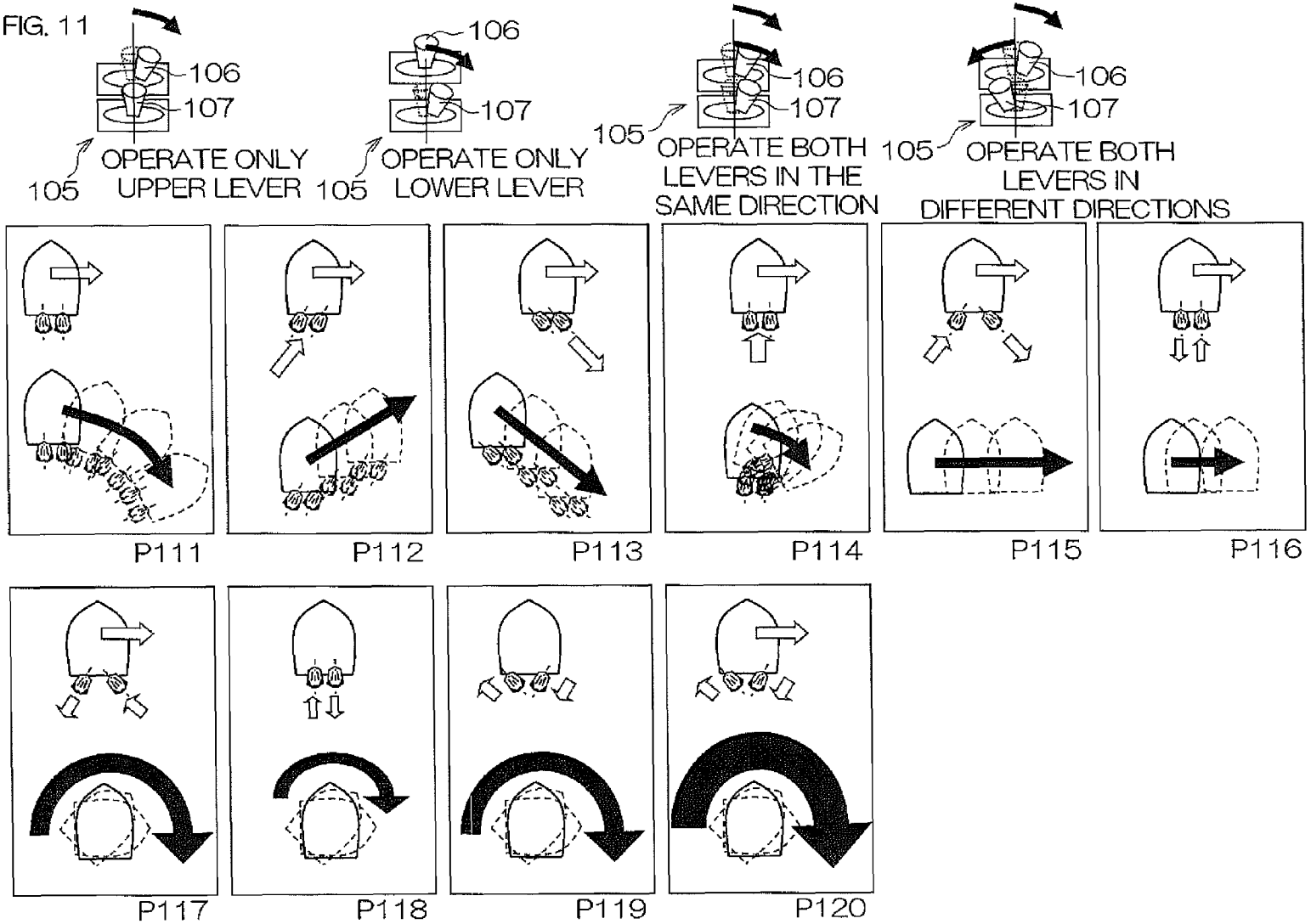
FIG. 11 shows a non-limiting example of a marine vessel maneuvering pattern group when a bow thruster and two outboard motors are provided as propulsion devices, and a lateral dual lever unit is provided as an auxiliary operation unit.

FIG. 11 shows a non-limiting example of a marine vessel maneuvering pattern group when a bow thruster and two outboard motors are provided as propulsion devices, and the lateral dual lever unit 105 is provided as an auxiliary operation unit 4C. The operations of the lateral dual lever unit 105 are, as described above, classified into operate only upper lever, operate only lower lever, operate both levers in the same direction, and operate both levers in different directions (refer to the upper section of FIG. 11).

To the operations of the lateral dual lever unit 105, for example, marine vessel maneuvering patterns P111 to P120 are provided. The marine vessel maneuvering patterns P111 to P120 correspond to hull behaviors to move or undergo stem turning in the right direction, but there are also prepared marine vessel maneuvering patterns corresponding to hull behaviors to move or undergo stem turning in the left direction, as well. Drive patterns and hull behaviors in the case of marine vessel maneuvering patterns corresponding to the left direction are left-right symmetric with the drive patterns and hull behaviors of the respective marine vessel maneuvering patterns shown in FIG. 11.

As can be immediately understood from a comparison with FIG. 9, the marine vessel maneuvering patterns P111 to P116 are the same as the marine vessel maneuvering patterns P91 to P96. Moreover, as can be immediately understood from a comparison with FIG. 10, the marine vessel maneuvering patterns P117 to P120 are the same as the marine vessel maneuvering patterns P103-3 to P103-6, respectively. Therefore, detailed description of the respective marine vessel maneuvering patterns will be omitted.

For example, for the "operate only upper lever," the marine vessel maneuvering patterns P111, P112, P114, P115, and P116 may be the selectable options. Moreover, for the "operate only lower lever," the marine vessel maneuvering patterns P111, P113, P114, P115, and P116 may be the selectable options. Further, for the "operate both levers in the same direction," the marine vessel maneuvering patterns P111 to P116 may be the selectable options. These marine vessel maneuvering patterns may be, for example, options for an operation to tilt the lever in the right direction. As options for an operation to tilt the lever in the left direction, it is preferable to use marine vessel maneuvering patterns that are left-right symmetric with the marine vessel maneuvering patterns P111 to P116. For the "operate both levers in different directions," the marine vessel maneuvering patterns P111, P114, and P117 to P120 may be the selectable options. These marine vessel maneuvering patterns may be, for example, options for an operation to tilt the upper lever 106 in the right direction and tilt the lower lever 107 in the left direction. As options for an operation to tilt the upper lever 106 in the left direction and tilt the lower lever 107 in the right direction, it is preferable to use marine vessel maneuvering patterns that are left-right symmetric with the marine vessel maneuvering patterns P111, P114, and P117 to P120.

Figure 12:
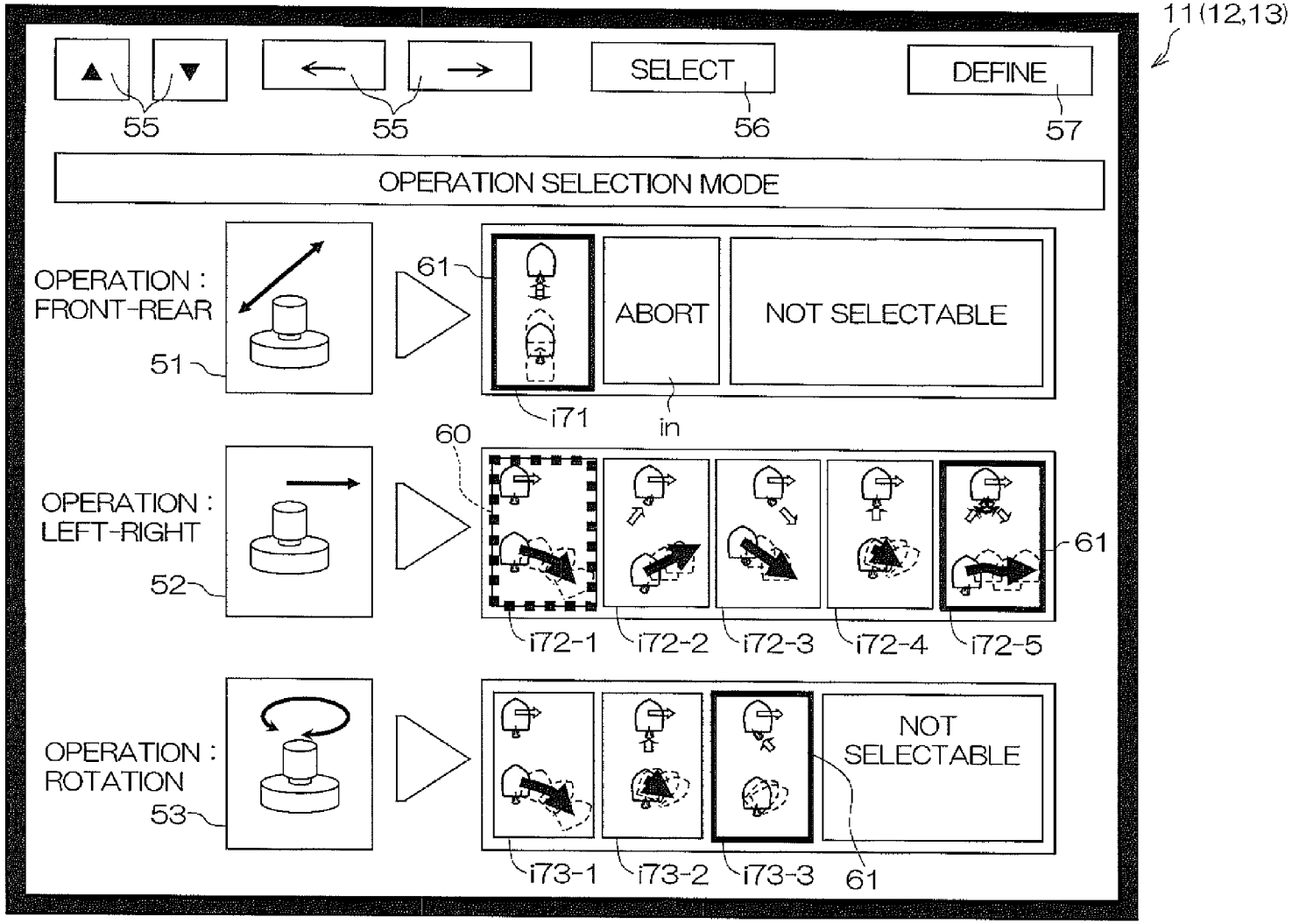
FIG. 12 shows a non-limiting example of a screen displayed on a display module of an input device when a marine vessel maneuvering pattern is selected.
Figure 13:
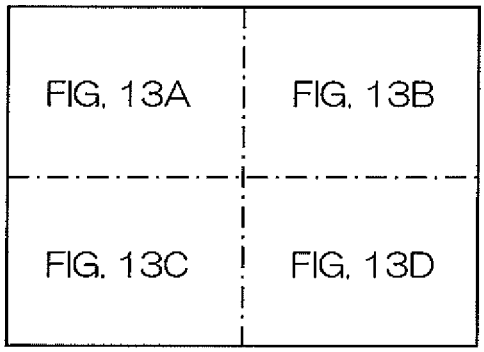
FIG. 13 shows a combination of FIG. 13A to FIG. 13D.
Figure 14:
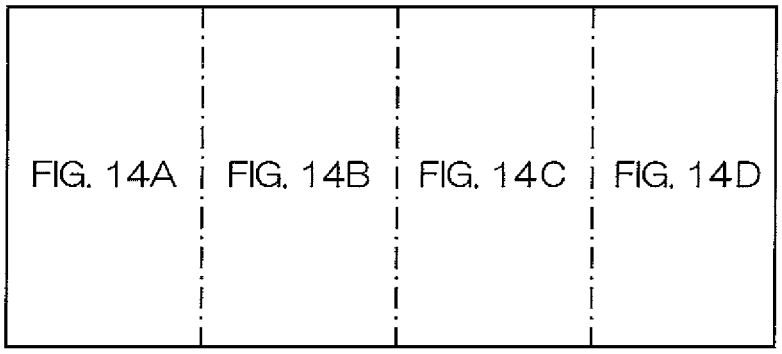
FIG. 14 shows a combination of FIG. 14A to FIG. 14D.
Figure 13B:
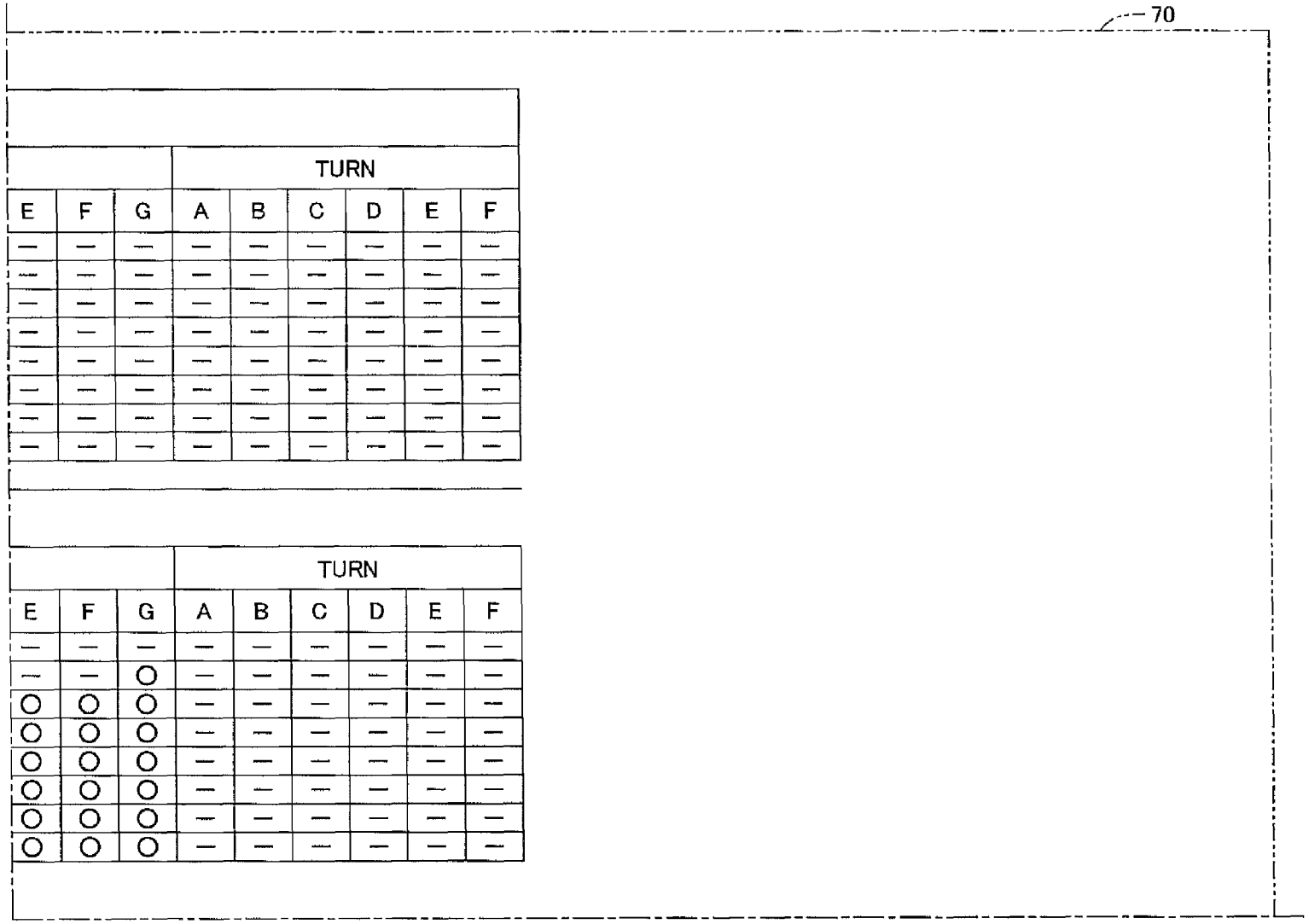

FIG. 12 shows a non-limiting example of a screen displayed on the display module 12 of the input device 11 when a marine vessel maneuvering pattern is selected. More specifically, a non-limiting screen arrangement example when a bow thruster and one outboard motor are provided as propulsion devices, and a joystick is provided as an auxiliary operation unit 4C is shown. On the screen of the display module 12, the marine vessel maneuvering patterns P71, P72-1 to P72-5, and P73-1 to P73-3 (refer also to FIG. 7) are displayed as option icons i71, i72-1 to i72-5, and i73-1 to i73-3. More specifically, an option icon i71 of the marine vessel maneuvering pattern P71 is disposed on the right side of a front-rear tilt display (schematic view) 51 of the joystick so as to correspond thereto. Moreover, option icons i72-1 to i72-5 of the marine vessel maneuvering patterns P72-1 to P72-5 are disposed on the right side of a left-right tilt display (schematic view) 52 of the joystick so as to correspond thereto. Further, option icons i73-1 to i73-3 of the marine vessel maneuvering patterns P73-1 to P73-3 are disposed on the right side of a turning operation display (schematic view) 53 of the joystick so as to correspond thereto.

In an upper screen portion of the display module 12, directional keys 55 for moving a cursor 60 (shown by a rectangular dotted line frame in FIG. 12) up and down and left and right, a select key 56, and a define key 57 are disposed. These keys 55 to 57 are input keys that allow performing a pressing operation by use of an input module 13 in the form of a touch panel provided on the display of the display module 12.

The operator, by operating the directional keys 55, moves the cursor 60 to the icon of a desired marine vessel maneuvering pattern, and operates the select key 56. Accordingly, the icon is brought into a selected state. In FIG. 12, the selected state is shown by a rectangular, thick solid line frame 61. The operator brings marine vessel maneuvering patterns into a selected state one each for a front-rear tilting operation, a left-right tilting operation, and a turning operation, and then operates the define key 57. Accordingly, selection information indicating the selected marine vessel maneuvering patterns is written and stored in the selection information storage section 22. Thus, selection of a marine vessel maneuvering pattern can be performed.

As shown in FIG. 12, for a front-rear lever tilting operation, only an option (option icon i71) for one marine vessel maneuvering pattern is displayed, and options for other marine vessel maneuvering patterns are not displayed. Likewise, for other lever operations, only options for selectable marine vessel maneuvering patterns are displayed. Therefore, the displayed marine vessel maneuvering patterns are all selectable, so that the operator can quickly select a marine vessel maneuvering pattern. An option(s) for a non-selectable marine vessel maneuvering pattern(s) may be displayed together, but is preferably displayed in a form(s) (for example, a grayed-out icon(s)) explicitly indicating being non-selectable. Also, it is preferable that the option(s) for a non-selectable marine vessel maneuvering pattern(s) is arranged so as not to be brought into a selected state even by a user performing a selecting operation or so as not to allow disposing the cursor 60.

Further, in FIG. 12, an option icon "in" to abort a front-rear lever tilting operation is provided. When an operation to select the option icon "in" is performed, the control unit 10 aborts a front-rear tilting operation of the lever.

FIG. 13A to FIG. 13D and FIG. 14A to FIG. 14D are views for explaining non-limiting examples of the marine vessel maneuvering pattern extraction section 26, and show marine vessel maneuvering pattern extraction maps. FIG. 13A to FIG. 13D represent one marine vessel maneuvering pattern extraction map 70 by being combined as shown in FIG. 13. Likewise, FIG. 14A to FIG. 14D represent one marine vessel maneuvering pattern extraction map 70 by being combined as shown in FIG. 14.

The marine vessel maneuvering pattern extraction map 70 includes marine vessel maneuvering patterns that are selectable for various equipment combinations of the marine vessel 1. In FIG. 13A to FIG. 13D and FIG. 14A to FIG. 14D, a marine vessel maneuvering pattern extraction map 70 indicating whether marine vessel maneuvering patterns are selectable for combinations of the auxiliary operation unit 4C and the propulsion devices is shown. FIG. 13A to FIG. 13D show a non-limiting example of a map divided for each equipment state of the auxiliary operation unit 4C. In contrast thereto, FIG. 14A to FIG. 14D show a non-limiting example of integration of maps regarding a plurality of equipment states of the auxiliary operation unit 4C.

In the non-limiting example of FIG. 13A to FIG. 13D, the marine vessel maneuvering pattern extraction map 70 is divided into four maps 70A, 70B, 70C, and 70D according to the equipment state of the auxiliary operation unit 4C. The first map 70A corresponds to a case where no auxiliary operation unit 4C is provided. The second map 70B corresponds to a case where a lateral lever unit is provided as an auxiliary operation unit 4C. The third map 70C corresponds to a case where a lateral dual lever unit is provided as an auxiliary operation unit 4C. The fourth map 70D corresponds to a case where a joystick unit is provided as an auxiliary operation unit 4C. In the non-limiting example of FIG. 14A to FIG. 14D, maps corresponding to the same equipment states of the auxiliary operation unit 4C are integrated into one.

The marine vessel maneuvering pattern extraction map 70 (70A, 70B, 70C, 70D), in FIG. 13A to FIG. 13D and FIG. 14A to FIG. 14D, includes an operation device describing portion 71, a propulsion device describing portion 72, and a marine vessel maneuvering pattern describing portion 73. The marine vessel maneuvering pattern describing portion 73 includes an operation instruction information describing portion 74, a drive pattern describing portion 75, and a selectability describing portion 76.

In the operation device describing portion 71, there is a description of all combinations of the auxiliary operation unit 4C that can be equipped. In the non-limiting examples of FIG. 13A to FIG. 13D and FIG. 14A to FIG. 14D, there is assumed a case where only one type of the lateral lever unit, lateral dual lever unit, and joystick unit can be equipped.

In the propulsion device describing portion 72, there is a description of all combinations of the presence or absence and number of elements of the propulsion device that can be equipped. Although a description has been omitted in the foregoing marine vessel pattern examples, in the marine vessel maneuvering pattern map examples of FIG. 13A to FIG. 13D and FIG. 14A to FIG. 14D, a trolling motor is set as one of the propulsion device elements that can be equipped, besides the bow thruster and outboard motors. The trolling motor is preferably an electric outboard motor, and a type of propulsion device for low-speed traveling. In the non-limiting examples of FIG. 13A to FIG. 13D and FIG. 14A to FIG. 14D, the presence/absence of a bow thruster, the presence/absence of a trolling motor, and one/two or more of the number of outboard motors can be combined. The operation device describing portion 71 and the propulsion device describing portion 72 are brought together to provide a description of all combinations of the operation device and propulsion devices that can be equipped.

A marine vessel maneuvering pattern is identified by the operation described in the operation instruction information describing portion 74 and the drive pattern (drive pattern of the propulsion device) described in the drive pattern describing portion 75. In the operation instruction information describing portion 74, there is a description of the types of operations of the operation device. That is, the lateral lever unit has only an operation of left-right tilting. The lateral dual lever unit has four operations to operate only upper lever, operate only lower lever, operate both levers in the same direction, and operate both levers in different directions. The joystick unit may have, for example, three operations of front-rear tilting, left-right tilting, and turning. In the drive pattern describing portion 75, there is a description of identification information to identify drive patterns (refer to FIG. 7 to FIG. 11) selectable for the combinations of the operation device, propulsion devices, and operations. In FIG. 13A to FIG. 13D and FIG. 14A to FIG. 14D, shown are non-limiting examples with "A" to "G" entered as identification information of drive patterns. "Abort" indicates a drive pattern to abort an input from the operation unit (refer to the option icon in of FIG. 12).

In the selectability describing portion 76, there is a description as to whether selection of the respective drive patterns is permitted for the combinations of the operation device, propulsion devices, and operations. In FIG. 13A to FIG. 13D and FIG. 14A to FIG. 14D, a symbol "○" is entered in the cell of a combination where selection is permitted, and a symbol "-" is entered in the cell of a combination where selection is not permitted.

The equipment recognition section 25 of the control unit 10 recognizes the types of the propulsion devices 3 and the operation devices 4 actually equipped on the marine vessel 1, and transfers the information to the marine vessel maneuvering pattern extraction section 26. The marine vessel maneuvering pattern extraction section 26, by making reference to the marine vessel maneuvering pattern extraction map 70, identifies a marine vessel maneuvering pattern including a drive pattern that is selectable for the actually equipped propulsion devices 3 and the operation devices 4 (a drive pattern corresponding to the symbol "○" in the marine vessel maneuvering pattern map), and transfers the information to the control section 23. The control section 23, when a marine vessel maneuvering pattern is selected by the input device 11, causes the marine vessel maneuvering pattern extracted by the marine vessel maneuvering pattern extraction section 26 to be displayed on the display module 12 in a selectable form. Thus, only an option for a marine vessel maneuvering pattern corresponding to the actual equipment is provided for selection by the operator as a selectable option.

Figure 15:
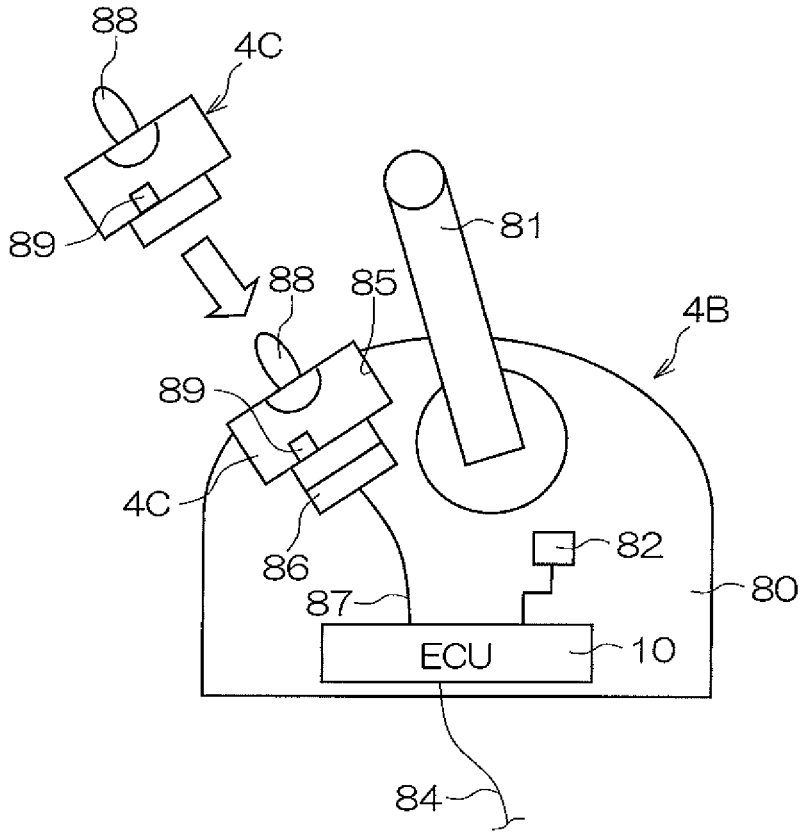
FIG. 15 is a schematic view for explaining a non-limiting example of an auxiliary operation unit.

FIG. 15 is a schematic view for explaining an attachment example of the auxiliary operation unit 4C. The auxiliary operation unit 4C preferably is, in this non-limiting example, freely removably attached to the output adjustment unit 4B. The output adjustment unit 4B includes a unit body 80 to be attached to the operation panel 8 (refer to FIG. 1) and an output adjustment lever 81 attached to the unit body 80 slidably in the front-rear direction. The operating position of the output adjustment lever 81 is read by an operating position sensor 82, and an output signal of the operating position sensor 82 is input to the control unit 10 built in the unit body 80. The control unit 10 is arranged to communicate with the outboard motors 3A and 3B etc., via a communication line 84.

In the unit body 80, an auxiliary unit attaching portion 85 is attached to attach the auxiliary operation unit 4C. The auxiliary unit attaching portion 85 is, in the non-limiting example of FIG. 15, a recess provided at a front surface to face an operator. On the auxiliary unit attaching portion 85, a connector 86 for electrical connection with the auxiliary operation unit 4C is disposed. The auxiliary operation unit 4C attached to the auxiliary unit attaching portion 85 is coupled to the connector 86. Accordingly, the auxiliary operation unit 4C is electrically coupled to the control unit 10 by the connector 86 and a signal line 87. The auxiliary operation unit 4C may include a built-in lever 88 and a built-in operating position sensor 89 to detect the operating position of the lever 88.

Thus, as a result of the auxiliary operation unit 4C being integrated into the output adjustment unit 4B, it becomes no longer necessary to provide an installation space for the auxiliary operation unit 4C on the operation panel 8. Moreover, if a plurality of types of auxiliary operation units 4C have been designed so as to fit in with the auxiliary unit attaching portion 85 provided in the unit body 80 of the output adjustment unit 4B, an auxiliary operation unit 4C selected from the plurality of types can be arbitrarily integrated with the output adjustment unit 4B.

Figure 16A:
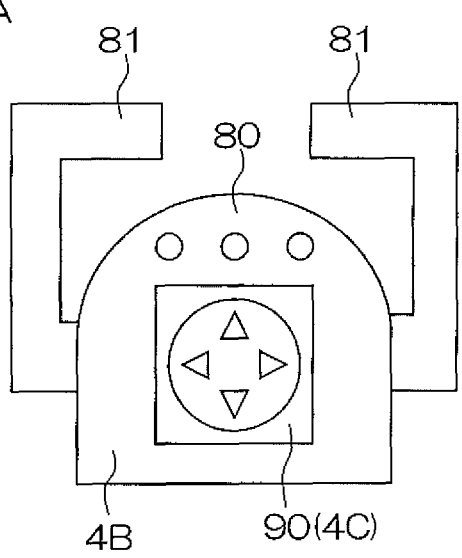
FIG. 16A and FIG. 16B show other non-limiting examples of the auxiliary operation unit.
Figure 16B:
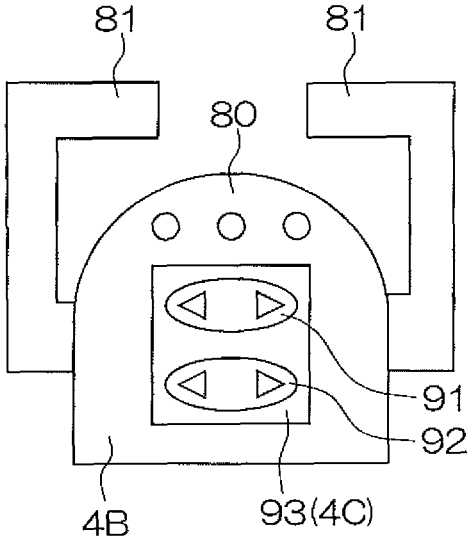

FIG. 16A and FIG. 16B show other non-limiting examples of the auxiliary operation unit 4C. FIG. 16A shows a cross key unit 90 that allows inputting directions to the front and rear and the left and right, and shows an arrangement of the cross key unit 90 integrated with the output adjustment unit 4B. FIG. 16B shows a dual switch unit 93 for which a pair of switches 91 and 92 that allow inputting directions to the left and right are disposed one on the other, and shows an arrangement of the dual switch unit 93 integrated with the output adjustment unit 4B.

As mentioned above, according to the present preferred embodiment, the marine vessel maneuvering pattern storage section 21 preferably stores a plurality of marine vessel maneuvering patterns, and based on a marine vessel maneuvering pattern selected therefrom, a command signal according to an operation signal of the operation devices 4 (particularly, the auxiliary operation unit 4C) is provided to the propulsion devices 3. Accordingly, a hull behavior corresponding to a previously selected marine vessel maneuvering pattern is obtained according to an operation of the auxiliary operation unit 4C, and therefore, operations for marine vessel maneuvering are easy. Moreover, because the marine vessel maneuvering pattern storage section 21 stores a plurality of marine vessel maneuvering patterns, if another marine vessel maneuvering pattern is selected, the marine vessel maneuvering pattern can be changed. Consequently, a marine vessel maneuvering pattern can be selected according to necessity without rewriting the control program. Accordingly, marine vessel maneuvering characteristics due to a marine vessel maneuvering pattern according to each users' individual wishes and the use and shape of the marine vessel, etc., can be achieved.

Moreover, when the operator selects one marine vessel maneuvering pattern by operating the input device 11 serving as a selection device, selection information to specify the selected marine vessel maneuvering pattern is written in the selection information storage section 22. Thus, by the operator's operation, the selection information in the selection information storage section 22 can be updated. The marine vessel maneuvering pattern can thus be changed. The operator in this case may be either a user of the marine vessel 1 or a boat builder who builds the marine vessel 1 by attaching the operation devices 4 and the propulsion devices 3 to a hull.

Moreover, in the present preferred embodiment, the actual equipment of the marine vessel 1, that is, the propulsion devices 3 and the operation devices 4 actually equipped on the marine vessel 1 are recognized by the equipment recognition section 25. The marine vessel maneuvering pattern extraction section 26 extracts a selectable marine vessel maneuvering pattern according to the equipment recognized by the equipment recognition section 25. An option representing the extracted marine vessel maneuvering pattern is displayed on the display module 12 in a state of allowing a selecting operation. Thus, only options corresponding to actually selectable marine vessel maneuvering patterns are selectable, so that a selecting operation of a marine vessel maneuvering pattern becomes easy.

The selection information stored in the selection information storage section 22 is maintained as former information until a selecting operation of a new marine vessel maneuvering pattern is performed by the input device 11. Accordingly, it is not necessary to perform a selecting operation of a marine vessel maneuvering pattern every time of marine vessel maneuvering, so that marine vessel maneuvering intended by the user becomes easy. If the selection information storage section 22 includes a memory area of a non-volatile memory, the memory content (selection information) of the selection information storage section 22 can be maintained even after the control unit 10 is powered off.

Moreover, according to the present preferred embodiment, the memory content of the marine vessel maneuvering pattern storage section 21 can be rewritten by the marine vessel maneuvering pattern rewriting section 27. That is, the memory content of the marine vessel maneuvering pattern storage section 21 can be updated according to necessity.

Moreover, according to the present preferred embodiment, the control unit 10 built in the output adjustment unit 4B serves the function as a control section 23 programmed to perform control for not only a lever operation of the output adjustment unit 4B but also an operation of the auxiliary operation unit 4C. Accordingly, the control of marine vessel maneuvering patterns and the output adjustment of a propulsion device can be integrated into the output adjustment unit 4B.

Further, the output adjustment unit 4B includes an auxiliary unit attaching portion 85 arranged to allow attaching and removing of the auxiliary operation unit 4C. Accordingly, the auxiliary operation unit 4C can be attached and removed to and from the output adjustment unit 4B, so that it becomes no longer necessary to provide a special space to dispose the auxiliary operation unit 4C on the operation panel 8. As a result, the layout in a marine vessel maneuvering space can be simplified, and further, an operation system that is easy to operate can be provided. Moreover, because the auxiliary operation unit 4C can be attached and removed, a necessary auxiliary operation unit can be selected and provided integrally with the output adjustment unit 4B. Moreover, as a result of the integration of the output adjustment unit 4B and the auxiliary operation unit 4C, switching of the operation system can be smoothly performed, so that a marine vessel 1 excellent in marine vessel maneuverability can be provided.

Thus, the present preferred embodiment provides a marine vessel propulsion apparatus capable of easily changing the marine vessel maneuvering pattern. Moreover, the present preferred embodiment provides a marine vessel for which a change in marine vessel maneuvering pattern is easy, and which easily obtains a hull behavior described by a user.

Although a preferred embodiment of the present invention has been described above, the present invention can be further embodied in many other forms. For example, besides the foregoing propulsion device, another propulsion device such as a stern thruster that is attached near the stern to generate a lateral thrust force may be equipped on the marine vessel. Moreover, in the foregoing preferred embodiment, a description has been given for the case where one or two outboard motors serving as main propulsion devices preferably are provided, but three or more outboard motors may be equipped on the marine vessel. Further, in the foregoing preferred embodiment, a description has been given of the marine vessel preferably including an outboard motor (s) as a main propulsion device (s), but the present invention can be applied also to marine vessels including main propulsion devices in other forms such as water jet drives and stern drives.

The present application corresponds to Japanese Patent Application No. 2012-176029 filed in the Japan Patent Office on Aug. 8, 2012, and the entire disclosure of the application is incorporated herein by reference.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine vessel propulsion control device comprising:

a marine vessel maneuvering pattern storage section that stores a plurality of marine vessel maneuvering patterns corresponding to a propulsion device attached to a marine vessel and an operation device attached to the marine vessel, including a plurality of marine vessel maneuvering patterns corresponding to a specific operation of the operation device;

a selection information storage section that stores selection information that specifies one marine vessel maneuvering pattern selected from the plurality of marine vessel maneuvering patterns;

a selection device to be operated by an operator to select a marine vessel maneuvering pattern stored in the marine vessel maneuvering pattern storage section, the selection device including a display unit that displays the plurality of marine vessel maneuvering patterns selectable by the operator; and a control section programmed to read out from the marine vessel maneuvering pattern storage section a marine vessel maneuvering pattern corresponding to the selection information stored in the selection information storage section, and to output a command signal to the propulsion device according to an operation signal of the operation device based on the read-out marine vessel maneuvering pattern.

2. The marine vessel propulsion control device according to claim 1, further comprising a selection information writing section that writes in the selection information storage section selection information to identify a marine vessel maneuvering pattern selected by the selection device.

3. The marine vessel propulsion control device according to claim 2, further comprising an equipment recognition section that recognizes the propulsion device and the operation device actually equipped on the marine vessel; and a marine vessel maneuvering pattern extraction section that extracts selectable marine vessel maneuvering patterns from the plurality of marine vessel maneuvering patterns stored in the marine vessel maneuvering pattern storage section based on the propulsion device and the operation device recognized by the equipment recognition section; wherein the selection device is programmed such that selection of a marine vessel maneuvering pattern by the operator is possible from the selectable marine vessel maneuvering patterns extracted by the marine vessel maneuvering pattern extraction section.

4. The marine vessel propulsion control device according to claim 2, wherein selection information stored in the selection information storage section is maintained as former information until a selecting operation of a new marine vessel maneuvering pattern is performed by the selection device.

5. The marine vessel propulsion control device according to claim 1, further comprising a marine vessel maneuvering pattern rewriting section that rewrites a marine vessel maneuvering pattern stored in the marine vessel maneuvering pattern storage section.

6. The marine vessel propulsion control device according to claim 1, further comprising an operation device recognition section that recognizes a type of the operation device actually equipped on a marine vessel.

7. The marine vessel propulsion control device according to claim 6, wherein the operation device recognition section is programmed to recognize the type of the operation device based on type identification information generated by the operation device.

8. The marine vessel propulsion control device according to claim 6, wherein the operation device recognition section is programmed to obtain information to identify the type of the operation device actually equipped on a marine vessel from an external input device.

9. The marine vessel propulsion control device according to claim 6, wherein the operation device recognition section is programmed to recognize the type of the operation device based on a type of an interface to which the operation device is connected.

10. The marine vessel propulsion control device according to claim 1, wherein the marine vessel maneuvering pattern storage section stores a marine vessel maneuvering pattern including operation instruction information corresponding to a type of the operation device.

11. The marine vessel propulsion control device according to claim 1, further comprising a propulsion device recognition section that recognizes a type of the propulsion device actually equipped on the marine vessel.

12. The marine vessel propulsion control device according to claim 11, wherein the propulsion device recognition section is programmed to recognize the type of the propulsion device based on type identification information generated by the propulsion device.

13. The marine vessel propulsion control device according to claim 11, wherein the propulsion device recognition section is programmed to obtain information to identify the type of the propulsion device actually equipped on a marine vessel from an external input device.

14. The marine vessel propulsion control device according to claim 1, wherein the marine vessel maneuvering pattern storage section stores a marine vessel maneuvering pattern corresponding to propulsion device number information indicating a number of a same type of the propulsion device.

15. The marine vessel propulsion control device according to claim 1, wherein the operation device includes an output adjustment unit to be operated by a user in order to adjust an output of the propulsion device; and the control section is provided in the output adjustment unit.

16. The marine vessel propulsion control device according to claim 15, wherein the operation device further includes an auxiliary operation unit; and the output adjustment unit includes an auxiliary unit attaching portion arranged to allow attachment and removal of the auxiliary operation unit.

17. The marine vessel propulsion control device according to claim 15, wherein the output adjustment unit includes a lever to be operated by a user, and the control section is programmed to control an output of the propulsion device in response to an operation of the lever.

18. A marine vessel propulsion apparatus comprising:

a propulsion device attached to a marine vessel;

an operation device attached to a marine vessel; and a marine vessel propulsion control device according to claim 1.

19. A marine vessel comprising:

a hull;

a propulsion device attached to the hull;

an operation device attached to the hull; and a marine vessel propulsion control device according to claim 1.

* * * * *